US010461401B2

(12) United States Patent
Ko et al.

(10) Patent No.: US 10,461,401 B2
(45) Date of Patent: Oct. 29, 2019

(54) ANTENNA DEVICE AND ELECTRONIC DEVICE INCLUDING THE SAME

(71) Applicant: Samsung Electronics Co., Ltd., Suwon-si, Gyeonggi-do (KR)

(72) Inventors: Seung-Tae Ko, Bucheon-si (KR); Yoon-Geon Kim, Seoul (KR); Kwang-Hyun Baek, Anseong-si (KR); Won-Bin Hong, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 148 days.

(21) Appl. No.: 15/261,199

(22) Filed: Sep. 9, 2016

(65) Prior Publication Data

US 2017/0069958 A1 Mar. 9, 2017

(30) Foreign Application Priority Data

Sep. 9, 2015 (KR) ..... 10-2015-0127429

(51) Int. Cl.
*H01Q 1/38* (2006.01)
*H01Q 1/24* (2006.01)
*H01Q 1/48* (2006.01)

(52) U.S. Cl.
CPC ..... *H01Q 1/243* (2013.01); *H01Q 1/38* (2013.01); *H01Q 1/48* (2013.01)

(58) Field of Classification Search
CPC ..... H01Q 1/243; H01Q 1/38; H01Q 1/48
See application file for complete search history.

(56) References Cited

U.S. PATENT DOCUMENTS 6,426,723 B1 * 7/2002 Smith ..... H01Q 1/22 343/700 MS
2004/0075613 A1 * 4/2004 Jarmuszewski ..... H01Q 1/243 343/702
2008/0158068 A1 * 7/2008 Huang ..... H01Q 1/243 343/700 MS
2013/0141284 A1 * 6/2013 Jeong ..... H01Q 1/38 343/700 MS
2013/0257672 A1 10/2013 Lu et al.
2013/0293420 A1 11/2013 Yehezkely
2014/0145883 A1 * 5/2014 Baks ..... H01Q 1/2283 343/700 MS
2014/0361946 A1 * 12/2014 Ganchrow ..... H01Q 9/285 343/795

(Continued)

*Primary Examiner* — Dieu Hien T Duong
(74) *Attorney, Agent, or Firm* — Jefferson IP Law, LLP

(57) ABSTRACT

An antenna device and an electronic device that includes the same are provided. The devices may each include a radiation conductor formed on a circuit board constituted by multiple layers, the radiation conductor being constituted by an electrically conductive pattern formed on at least one of the multiple layers constituting the circuit board or by a combination of electrically conductive patterns formed on the multiple layers, a ground conductor disposed on the circuit board to supply reference potential for the radiation conductor, a feeding line disposed on the circuit board to supply power to the radiation conductor, and a dummy conductor disposed on the circuit board, and the dummy conductor may be mounted to make contact with, or to be adjacent to, at least one of the radiation conductor, the ground conductor, and the feeding line.

19 Claims, 24 Drawing Sheets

(56) References Cited

U.S. PATENT DOCUMENTS

| | | | | |
|---|---|---|---|---|
| 2016/0006133 | A1* | 1/2016 | Ganchrow | H01Q 1/24<br>343/879 |
| 2016/0172761 | A1* | 6/2016 | Garcia | H01Q 21/28<br>343/700 MS |

* cited by examiner

ANTENNA DEVICE AND ELECTRONIC DEVICE INCLUDING THE SAME

CROSS-REFERENCE TO RELATED APPLICATION(S)

This application claims the benefit under 35 U.S.C. § 119(a) of a Korean patent application filed on Sep. 9, 2015 in the Korean Intellectual Property Office and assigned Serial number 10-2015-0127429, the entire disclosure of which is hereby incorporated by reference.

TECHNICAL FIELD

The present disclosure relates to an antenna device. More particularly, the present disclosure relates to an antenna device and an electronic device that includes the same, with the antenna device being capable of ensuring compactness and stable radiation efficiency.

BACKGROUND

Radio communication technologies have recently been implemented in various manners, such as a wireless local area network (w-LAN) represented by a Wi-Fi technology, Bluetooth, near field communication (NFC), etc., as well as commercialized mobile communication network access. Mobile communication services have gradually evolved from first-generation mobile communication services focused on voice calls into high-speed and high-capacity services (e.g., high-definition video streaming services), and next-generation mobile communication services, including wireless gigabit (WiGig), etc., which will be commercialized in the future, are expected to be provided through an ultra-high frequency band of tens of GHz or higher.

With the activation of communication standards, such as a wireless local area network, Bluetooth (BT), etc., electronic devices (e.g., mobile communication terminals) have been equipped with antenna devices that operate in various different frequency bands. For example, fourth-generation mobile communication services have been operated in a frequency band of 700 MHz, 1.8 GHz, 2.1 GHz, etc., Wi-Fi has been operated in a frequency band of 2.4 GHz and 5 GHz although there is a slight difference depending on standards, and Bluetooth has been operated in a frequency band of 2.45 GHz.

In order to provide stable service quality in commercialized radio communication networks, high gains and a wide range of beam coverage of antenna devices have to be satisfied. Since next-generation mobile communication services are to be provided through an ultra-high frequency band of tens of GHz or higher (e.g., a frequency band ranging from 30 GHz to 300 GHz and a wavelength at resonant frequency ranging from about 1 mm to about 10 mm), antenna devices for the next-generation mobile communication services may require a higher performance than antenna devices used for previously commercialized mobile communication services.

Antenna devices used in a frequency band of tens of GHz or higher (hereinafter, referred to as 'mmWave communication') may merely have a resonant frequency wavelength of 1 to 10 mm, and radiators thereof may become smaller in size. Furthermore, in order to restrict transmission losses generated between communication circuits and radiators, antenna devices used for mmWave communication may include a radio frequency (RF) module having a transmission/reception circuit unit therein and a radiation conductor, which are disposed adjacent to each other on a single circuit board. The radio frequency module may convert radio signals, which are transmitted and received through the radiation conductor, into digital signals, and vice versa.

The above information is presented as background information only to assist with an understanding of the present disclosure. No determination has been made, and no assertion is made, as to whether any of the above might be applicable as prior art with regard to the present disclosure.

SUMMARY

In the implementation of antenna devices that operate in the same frequency band, the radiation efficiency of the antenna devices may increase with an increase in the volume of the antenna devices. However, since there is a difficulty in ensuring sufficient installation space in compact electronic devices, such as mobile communication terminals, it may be difficult to ensure the radiation efficiency of antenna devices having radiation conductors mounted on circuit boards. For example, as the installation spaces of antenna devices become narrower, the radiation efficiency, gain, bandwidth, and the like of the antenna devices may be deteriorated, and when a plurality of radiation conductors is disposed, a degradation in the performance of the antenna devices may become more serious on account of interference between the conductors.

Aspects of the present disclosure are to address at least the above-mentioned problems and/or disadvantages and to provide at least the advantages described below. Accordingly, an aspect of the present disclosure is to provide an antenna device and an electronic device that includes the same, in which the antenna device may be easily installed in a narrow mounting space and may ensure stable radiation efficiency.

Another aspect of the present disclosure is to provide an antenna device and an electronic device that includes the same, in which a radiation conductor or ground conductor may be implemented with an electrically conductive pattern within a circuit board, and a dummy conductor may be mounted on the radiation conductor and/or the ground conductor on the surface of the circuit board to enhance electromagnetic properties.

Another aspect of the present disclosure is to provide an antenna device and an electronic device that includes the same, in which the surface mounting technology (SMT) may be used to mount a dummy conductor, thereby facilitating the manufacturing of the antenna device.

In accordance with an aspect of the present disclosure, an antenna device and an electronic device that includes the same are provided. The antenna device and electronic device include a radiation conductor formed on a circuit board constituted by multiple layers, the radiation conductor being constituted by an electrically conductive pattern formed on at least one of the multiple layers constituting the circuit board or by a combination of electrically conductive patterns formed on the multiple layers, a ground conductor disposed on the circuit board to supply reference potential for the radiation conductor, a feeding line disposed on the circuit board to supply power to the radiation conductor, and a dummy conductor disposed on the circuit board, and the dummy conductor may be mounted (or configured) to make contact with, or to be adjacent to, at least one of the radiation conductor, the ground conductor, and the feeding line.

According to the various embodiments, a radio frequency module may be mounted on the circuit board to supply power to the radiation conductor through the feeding line.

According to the various embodiments, the electronic device may include a main circuit board and integrated circuit chip(s) mounted on the main circuit board, and the antenna device may be embedded in the integrated circuit chip(s).

The antenna device, according to the various embodiments of the present disclosure, may have the radiation conductor and/or the ground conductor formed by the electrically conductive pattern within the circuit board or by a combination of the electrically conductive patterns within the circuit board and may expand the radiation conductor and/or the ground conductor by mounting the dummy conductor on the surface of the circuit board, thereby enhancing and stabilizing the radiation efficiency thereof Although the dummy conductor is disposed on the surface of the circuit board, the dummy conductor may be disposed in a lower position than, and/or at the same height as, the integrated circuit chips or active/passive devices arranged on the circuit board, thereby facilitating the installation of the antenna device in a narrow mounting space. In addition, the dummy conductor may be mounted using the surface mounting technology for mounting an integrated circuit chip on a circuit board, thereby restricting a manufacturing cost increase due to the addition of a process.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
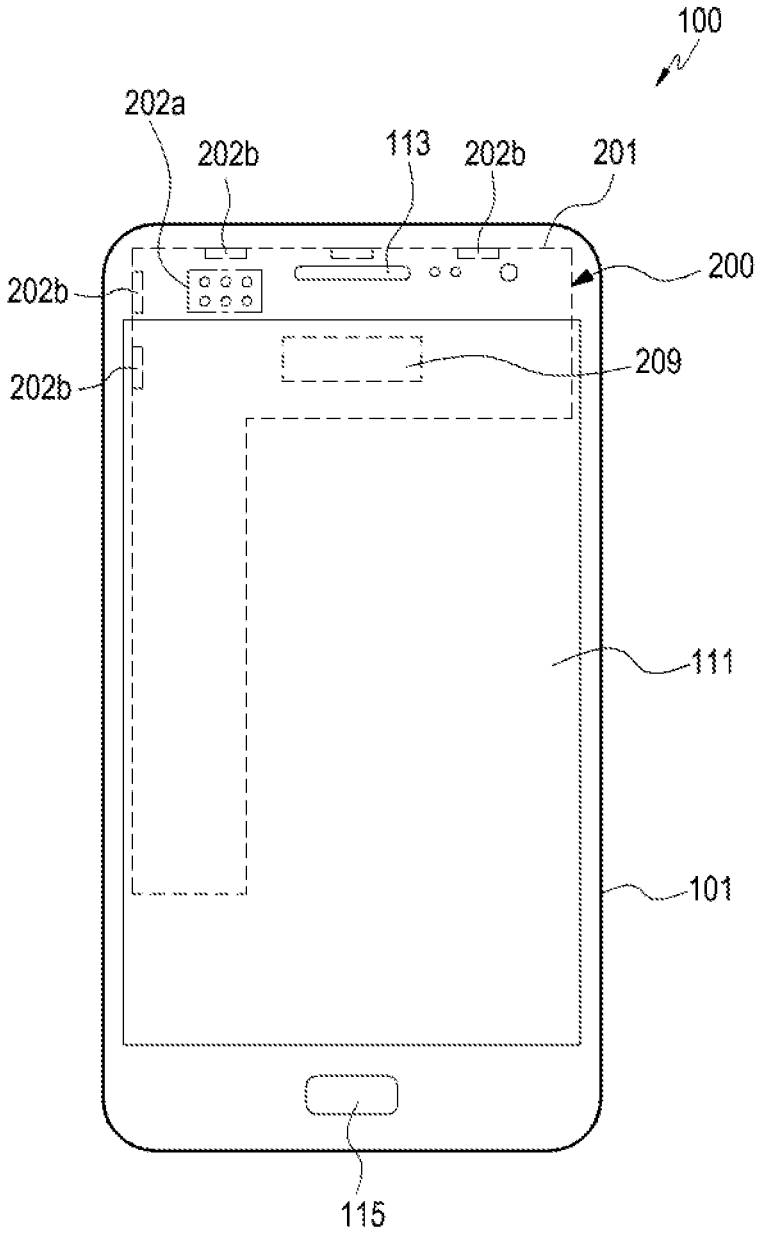
FIG. 1 is a view illustrating an electronic device that includes an antenna device according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the various embodiments of the present disclosure, the expression "A or B", "at least one of A or/and B", or "one or more of A or/and B" may include all possible combinations of the items listed. For example, the expression "A or B", "at least one of A and B", or "at least one of A or B" refers to all of (1) including at least one A, (2) including at least one B, or (3) including all of at least one A and at least one B.

The expression "a first", "a second", "the first", or "the second" used in various embodiments of the present disclosure may modify various components regardless of the order and/or the importance but does not limit the corresponding components. For example, a first user device and a second user device indicate different user devices although both of them are user devices. For example, a first element may be termed a second element, and similarly, a second element may be termed a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposer between them. In contrast, it may be understood that when an element (e.g., first element) is referred to as being "directly connected," or "directly coupled" to another element (second element), there are no element (e.g., third element) interposed between them.

The expression "configured to" used in the present disclosure may be exchanged with, for example, "suitable for", "having the capacity to", "designed to", "adapted to", "made to", or "capable of" according to the situation. The term "configured to" may not necessarily imply "specifically designed to" in hardware. Alternatively, in some situations, the expression "device configured to" may mean that the device, together with other devices or components, "is able to". For example, the phrase "processor adapted (or configured) to perform A, B, and C" may mean a dedicated processor (e.g., embedded processor) only for performing the corresponding operations or a generic-purpose processor (e.g., central processing unit (CPU) or application processor (AP)) that can perform the corresponding operations by executing one or more software programs stored in a memory device.

In the description, it should be understood that the terms "include" or "have" indicate existence of a feature, a number, an operation, a structural element, parts, or a combination thereof, and do not previously exclude the existences or probability of addition of one or more another features, numeral, operations, structural elements, parts, or combinations thereof.

Unless defined differently, all terms used herein, which include technical terminologies or scientific terminologies, have the same meaning as that understood by a person skilled in the art to which the present disclosure belongs. Such terms as those defined in a generally used dictionary are to be interpreted to have the meanings equal to the contextual meanings in the relevant field of art, and are not to be interpreted to have ideal or excessively formal meanings unless clearly defined in the present specification. In some cases, even the term defined in the present disclosure should not be interpreted to exclude embodiments of the present disclosure.

In the present disclosure, an electronic device may be a random device, and the electronic device may be called a terminal, a portable terminal, a mobile terminal, a communication terminal, a portable communication terminal, a portable mobile terminal, a display device or the like.

For example, the electronic device may be a smartphone, a portable phone, a game player, a television (TV), a display unit, a heads-up display unit for a vehicle, a notebook computer, a laptop computer, a tablet personal computer (PC), a personal media player (PMP), a personal digital assistants (PDA), and the like. The electronic device may be implemented as a portable communication terminal which has a wireless communication function and a pocket size. Further, the electronic device may be a flexible device or a flexible display device.

The electronic device may communicate with an external electronic device, such as a server or the like, or perform an operation through an interworking with the external electronic device. For example, the electronic device may transmit an image photographed by a camera and/or position information detected by a sensor unit to the server through a network. The network may be a mobile or cellular communication network, a local area network (LAN), a wireless local area network (WLAN), a wide area network (WAN), an internet, a small area network (SAN) or the like, but is not limited thereto.

FIG. 1 is a view illustrating an electronic device 100 that includes an antenna device 200 according to various embodiments of the present disclosure.

Referring to FIG. 1, the electronic device 100 is, for example, a bar type terminal that includes a housing 101. The electronic device 100 may include: a display device 111 disposed on the front surface thereof; an audio module 113 for outputting sounds; and at least one key 115 disposed on one side of the display device 111. The audio module 113 may be disposed on one side of the display device 111 and may be used for a voice call. The electronic device 100 may have the main circuit board 201 therein on which a processor, a communication module, an audio module, and integrated circuit chip(s), such as a memory, etc., are mounted, and may include the antenna device 200 to perform radio communication.

The antenna device 200 may be disposed in one area of the main circuit board 201, and may include: first radiation unit(s) 202*a* disposed on at least one surface of the main circuit board 201; and second radiation unit(s) 202*b* disposed on a side surface (or the edge) of the main circuit board 201. According to various embodiments, a plurality of second radiation units 202*b* may be arranged along the edge of the main circuit board 201 so as to be spaced apart from each other. According to various embodiments, the circuit board on which the antenna device 200 is disposed may be prepared separately from the main circuit board 201 and may be mounted on the main circuit board 201.

In the following description, the 'circuit board' on which the antenna device 200 is disposed or the 'main circuit board' may be described as referring to the same element and may be provided with the same reference numeral. When it is necessary to distinguish between the main circuit board of the electronic device 100 and the circuit board of the antenna device 201, they may be identified by the reference numerals thereof, but the present disclosure does not have to be limited thereto. For example, the antenna device 200 may be disposed on the main circuit board of the electronic device 100, or may be mounted on the main circuit board while being disposed on a separate circuit board, as mentioned above. In an example of disposing the antenna device 200 on a circuit board that is prepared separately from the main circuit board of the electronic device 100, the circuit board may be referred to as the 'antenna substrate' in the following description.

The antenna device 200 may include a radio frequency (RF) module 209 mounted on the antenna substrate 201. The radio frequency module 209 may convert a digital signal into an analogue signal to supply a feeding signal to the first and/or second radiation unit(s) 202*a*, 202*b* and may convert a radio signal received through the first and/or second radiation unit(s) 202*a*, 202*b* into a digital signal. For example, the first and/or second radiation unit(s) 202*a*, 202*b* may be supplied with a feeding signal through the radio frequency module 209 and may supply a received radio signal to the radio frequency module 209.

Figure 2:
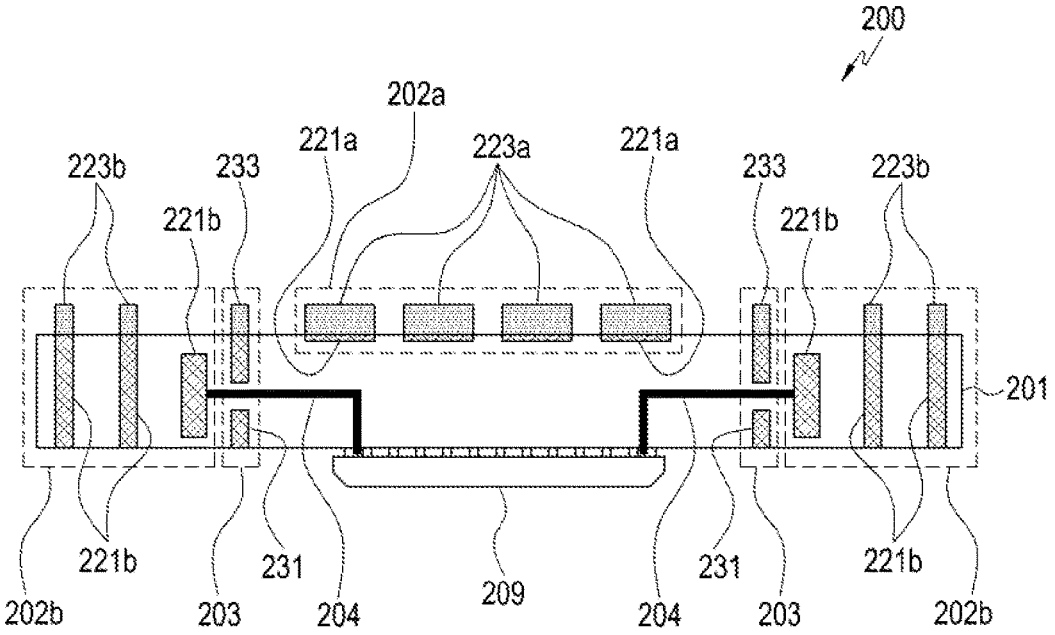
FIG. 2 is a view illustrating the antenna device according to one of various embodiments of the present disclosure.

FIG. 2 is a view illustrating the antenna device 200 according to one of various embodiments of the present disclosure.

Referring to FIG. 2, the antenna device 200 may include the first radiation unit(s) 202*a*, the second radiation unit(s) 202*b*, ground unit(s) 203, the radio frequency module 209, and/or a feeding line 204, and may be disposed on the antenna substrate 201. The first and/or second radiation unit(s) 202*a*, 202*b* may include: radiation conductors 221*a*, 221*b* disposed on the antenna substrate 201; and dummy conductors 223*a*, 223*b* mounted on at least one surface and/or at least one side surface of the antenna substrate 201 and connected to the radiation conductors 221*a*, 221*b*. The first radiation unit(s) 202*a* may be disposed on at least one surface of the antenna substrate 201, and the second radiation unit(s) 202*b* may be disposed on one side edge of the antenna substrate 201. According to various embodiments, a plurality of second radiation units 202*b* may be arranged along the edge of the antenna substrate 201 so as to be spaced apart from each other.

The ground unit(s) 203 may supply reference potential for the first and/or second radiation unit(s) 202*a*, 202*b* and may be disposed on the antenna substrate 201. For example, the ground unit(s) 203 may include: an internal ground conductor 231 of the antenna substrate 201; and dummy conductor(s) 233 mounted on at least one surface of the antenna substrate 201 and connected to the ground conductor 231. The ground unit(s) 203 for supplying reference potential for the first and/or second radiation unit(s) 202*a*, 202*b*, as mentioned above, may be disposed adjacent to the first and/or second radiation unit(s) 202*a*, 202*b*.

According to various embodiments, the radiation conductors 221*a*, 221*b* and/or the ground conductor 231 may be formed by an electrically conductive pattern formed on the antenna substrate 201 and/or by a combination of electrically conductive patterns formed on the antenna substrate 201. In an embodiment, the antenna substrate 201 may be a multi-layer circuit board that includes a plurality of layers, and the radiation conductors 221*a*, 221*b* and/or the ground conductor 231 may be formed by a combination of via holes formed in the layers constituting the antenna substrate 201 and/or electrical conductors with which the via holes are filled. In an embodiment, the radiation conductors 221*a*, 221*b* and/or the ground conductor 231 may be formed by a combination of electrically conductive patterns formed on the antenna substrate 201 and via holes formed in the layers constituting the antenna substrate 201.

The feeding line 204 may be a part of a printed circuit pattern formed on the antenna substrate 201 and may be partially disposed on the surface of the antenna substrate 201. Since an insulating material may be applied to the surface of the antenna substrate 201, the feeding line 204 may be insulated from an external environment even though the feeding line 204 is disposed on the surface of the antenna substrate 201. The feeding line 204 may extend from the radio frequency module 209 and may be directly connected to the first and/or second radiation unit(s) 202*a*, 202*b*. According to various embodiments, at least one of the radiation conductors 221*a*, 221*b* of the first and/or second radiation unit(s) 202*a*, 202*b* may have an indirect feeding structure in which power is supplied thereto through capacitive coupling with the feeding line 204.

Figure 3:
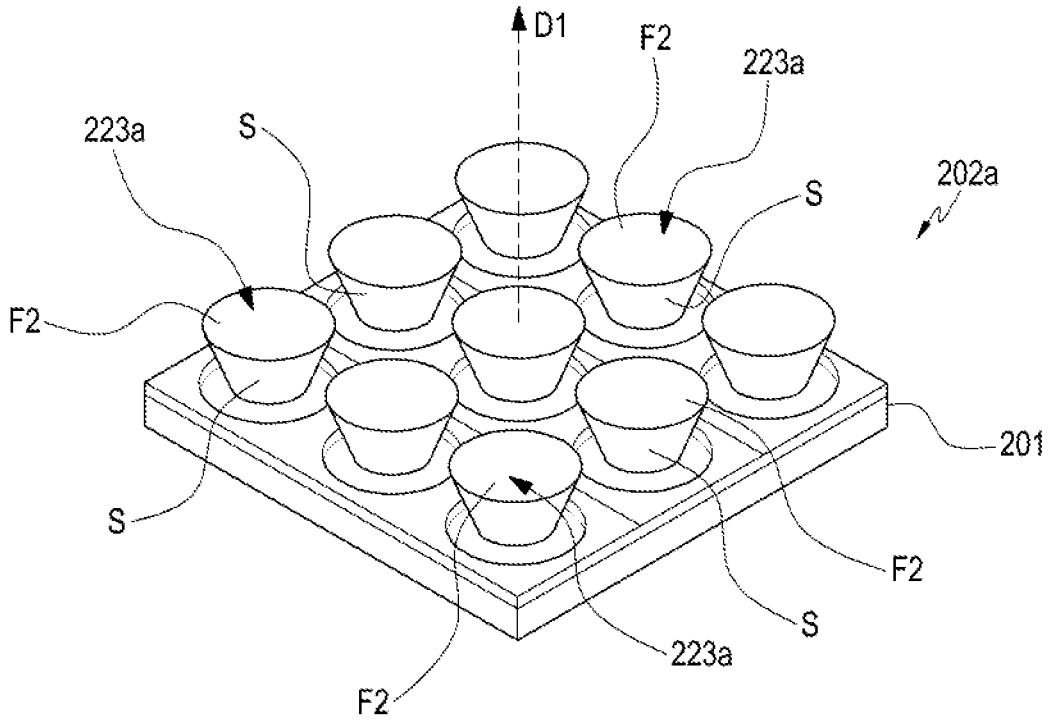
FIG. 3 is a perspective view illustrating an example in which radiation conductors and dummy conductors are arranged in the antenna device according to one of various embodiments of the present disclosure.

FIG. 3 is a perspective view illustrating an example in which the radiation conductors and the dummy conductors are arranged in the antenna device according to one of various embodiments of the present disclosure.

Figure 4:
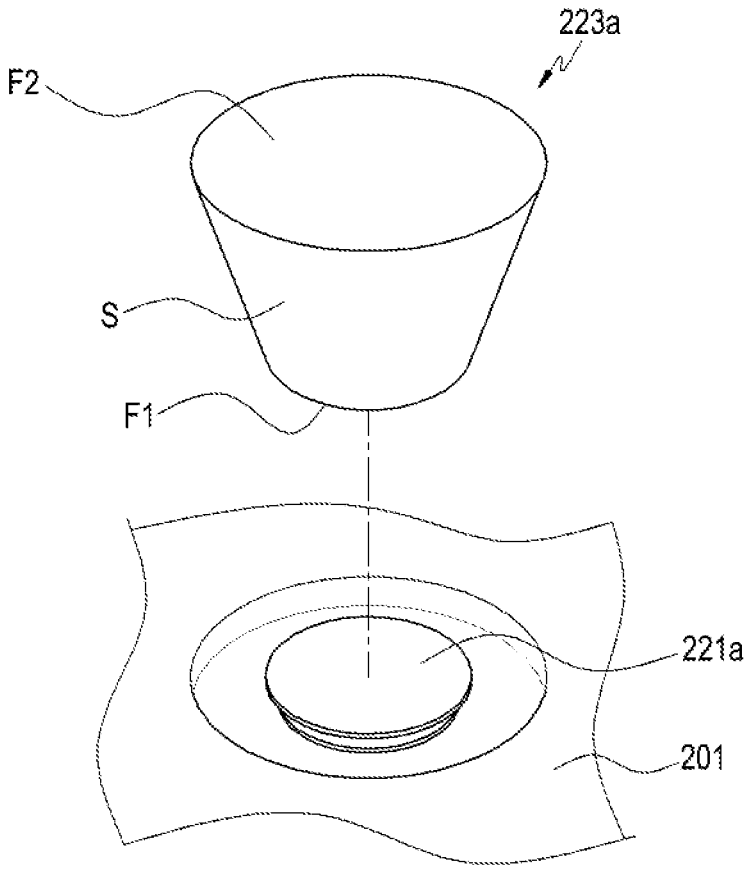
FIG. 4 is an exploded perspective view for explaining the example in which the radiation conductors and the dummy conductors are arranged in the antenna device according to one of various embodiments of the present disclosure.

FIG. 4 is an exploded perspective view for explaining the example in which the radiation conductors and the dummy conductors are arranged in the antenna device according to one of various embodiments of the present disclosure.

Figure 5:
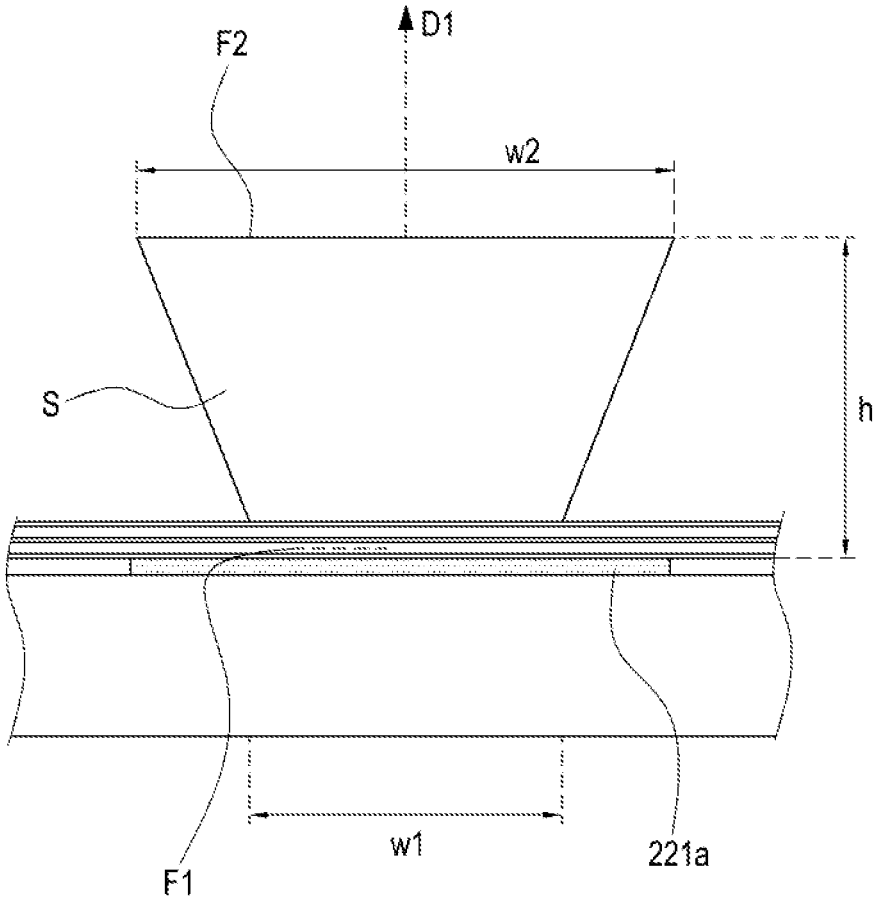
FIG. 5 is a side view illustrating the example in which the radiation conductors and the dummy conductors are arranged in the antenna device according to one of various embodiments of the present disclosure.

FIG. 5 is a side view illustrating the example in which the radiation conductors and the dummy conductors are arranged in the antenna device according to one of various embodiments of the present disclosure.

Referring to FIGS. 3 to 5, the first radiation unit 202*a* may be disposed on one surface of the antenna substrate 201 to radiate a radio signal in the direction D1 of the surface of the antenna substrate 201, and may include the first radiation conductor(s) 221*a* and the first dummy conductor(s) 223*a*. The first radiation conductor 221*a* may include, for example, a radiation patch having a circular and/or polygonal plate shape. The first radiation conductor 221*a* may be mounted on (or attached to) the surface of the antenna substrate 201 and may be connected to the radio frequency module 209 through the feeding line 204 to transmit and receive radio signals. According to various embodiments, a plurality of first radiation conductors 221*a* may be arranged on the surface of the antenna substrate 201 with a specified interval therebetween.

The first dummy conductor 223*a* may include: a first surface F1 that faces the first radiation conductor 221*a*; a second surface F2 that is opposite to the first surface F1; and a side surface S that connects the first and second surfaces F1, F2. The first dummy conductor 223*a* may be mounted such that the first surface F1 faces the first radiation conductor 221*a*. The first dummy conductor 223*a* may be mounted on the first radiation conductor 221*a* to expand the magnitude (e.g., electrical length) of the first radiation conductor 221*a*. According to various embodiments, when the first dummy conductor 223*a* is mounted on the first radiation conductor 221*a*, the side surface S may extend so as to be inclined with respect to the surface of the antenna substrate 201. For example, the second surface F2 may be parallel to the first surface F1 and may have a larger width or area than the first surface F1.

Since the first dummy conductor 223*a* is mounted on the first radiation conductor 221*a*, the first radiation unit 202*a* may ensure a more enhanced antenna gain than when the first radiation unit 202*a* radiates a radio signal only with the first radiation conductor 221*a*. A variation in the antenna gain according to the mounting of the first dummy conductor 223*a* will be described below with reference to FIGS. 6 to 8.

Figure 6:
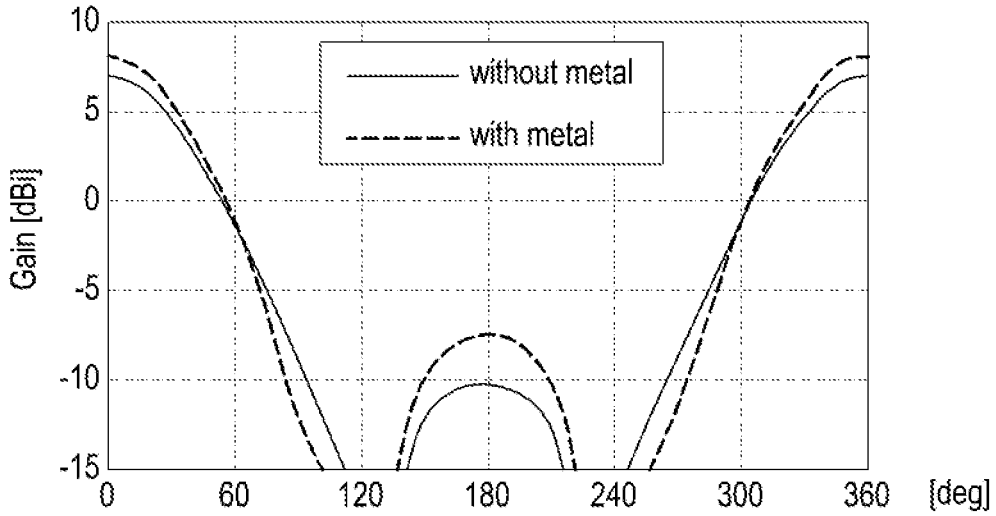
FIG. 6 is a graph for explaining the radiation efficiency of the antenna device according to one of various embodiments of the present disclosure.

FIG. 6 is a graph for explaining the radiation efficiency of the antenna device 200 according to one of various embodiments of the present disclosure.

Figure 7:
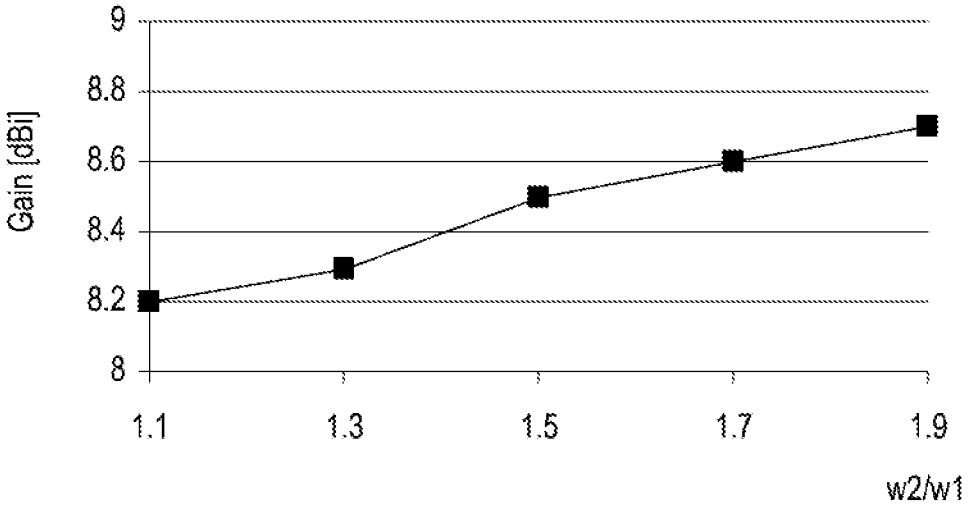
FIGS. 7 and 8 are graphs for explaining a variation in the radiation efficiency of the antenna device, according to a specification of the dummy conductor, according to one of various embodiments of the present disclosure.
Figure 8:
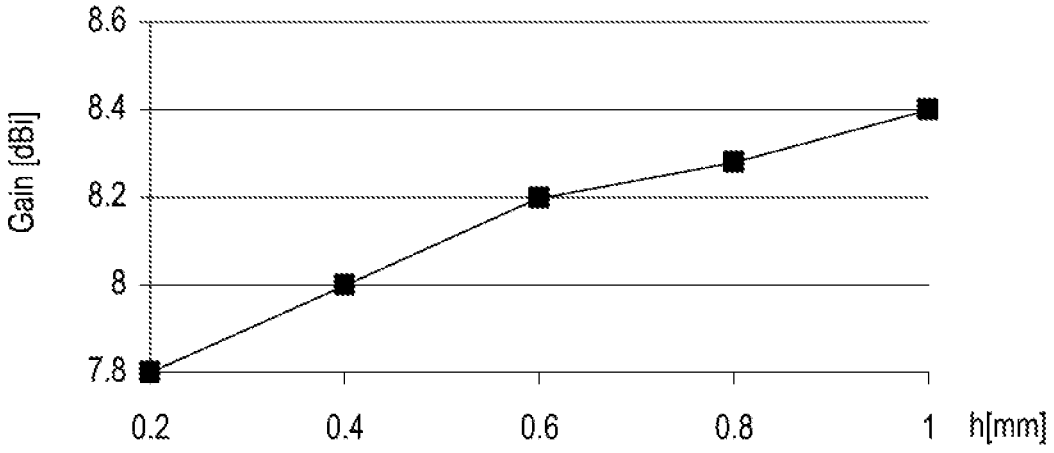

FIGS. 7 and 8 are graphs for explaining a variation in the radiation efficiency of the antenna device 200, according to the specification of the dummy conductor, according to one of various embodiments of the present disclosure.

In FIG. 6, the graph indicated by the legend 'without metal' may represent an antenna gain that is obtained by the first radiation conductor 221*a* itself before the first dummy conductor 223*a* is mounted thereon, and the graph indicated by the legend 'with metal' may represent an antenna gain that is obtained while the first dummy conductor 223*a* is mounted on the first radiation conductor 221*a*.

Referring to FIG. 6, it can be seen that the antenna gain of the first radiation unit 202*a* increases by about 2 dBi in the direction of 0 degrees and/or 360 degrees (e.g., in the radiation direction D1 of the first radiation conductor 221*a*) when the first dummy conductor 223*a* is mounted.

FIG. 7 shows a variation in the antenna gain according to a ratio of the width (or area) w2 (shown in FIG. 5) of the second surface F2 to the width (or area) w1 (shown in FIG. 5) of the first face F1. For example, it can be seen that the antenna gain of the first radiation unit 202*a* increases with a reduction in the width w1 of the first surface F1 and with an increase in the width w2 of the second surface F2. According to various embodiments, the shape and size of the first surface F1 may substantially agree with those of the first radiation conductor 221*a* in order to restrict the electrical connection loss between the first radiation conductor 221*a* and the first dummy conductor 223*a*.

Referring to FIG. 8, the antenna gain of the first radiation unit 202*a* may increase with an increase in the height h of the first dummy conductor 223*a*. According to various embodiments, the height of the first dummy conductor 223*a* may be limited since the antenna device 200 may include a part of the main circuit board of an electronic device (e.g., the above-described electronic device 100 shown in FIG. 1). For example, if the antenna substrate 201 is a part of the main circuit board of the electronic device 100, and an integrated circuit chip is mounted on the main circuit board of the electronic device 100, the first dummy conductor 223*a* may be disposed in a lower position than, and/or at the same height as, an integrated circuit chip mounted on the antenna substrate 201.

Figure 9:
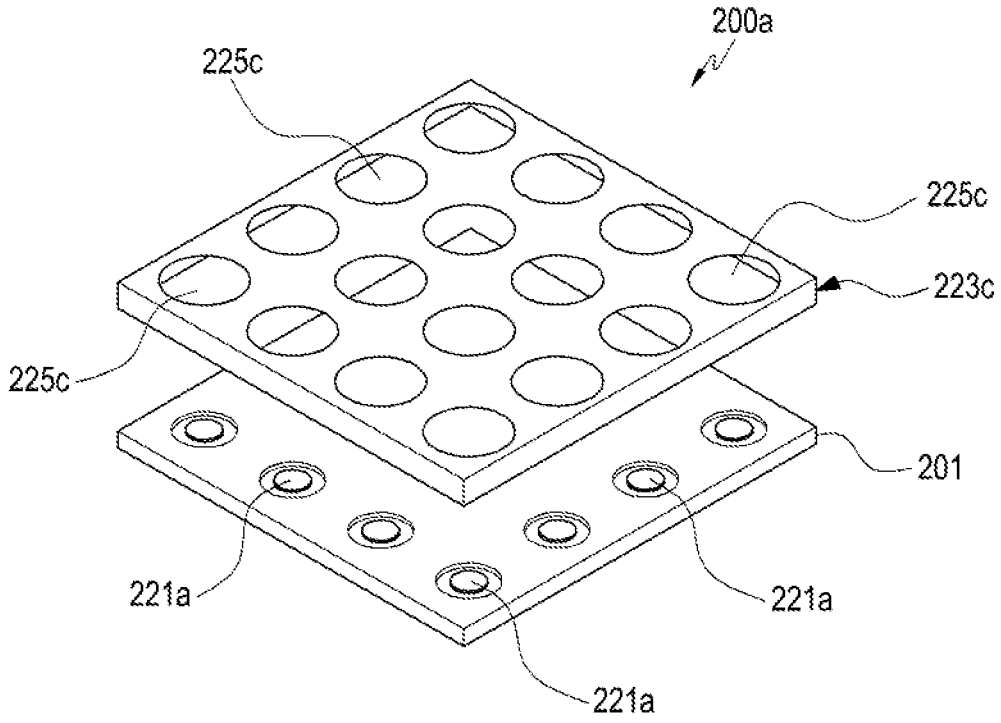
FIG. 9 is an exploded perspective view for explaining another example in which a radiation conductor and a dummy conductor are arranged in an antenna device according to one of various embodiments of the present disclosure.

FIG. 9 is an exploded perspective view for explaining another example in which a radiation conductor and a dummy conductor are arranged in an antenna device 200*a* according to one of various embodiments of the present disclosure.

Figure 10:
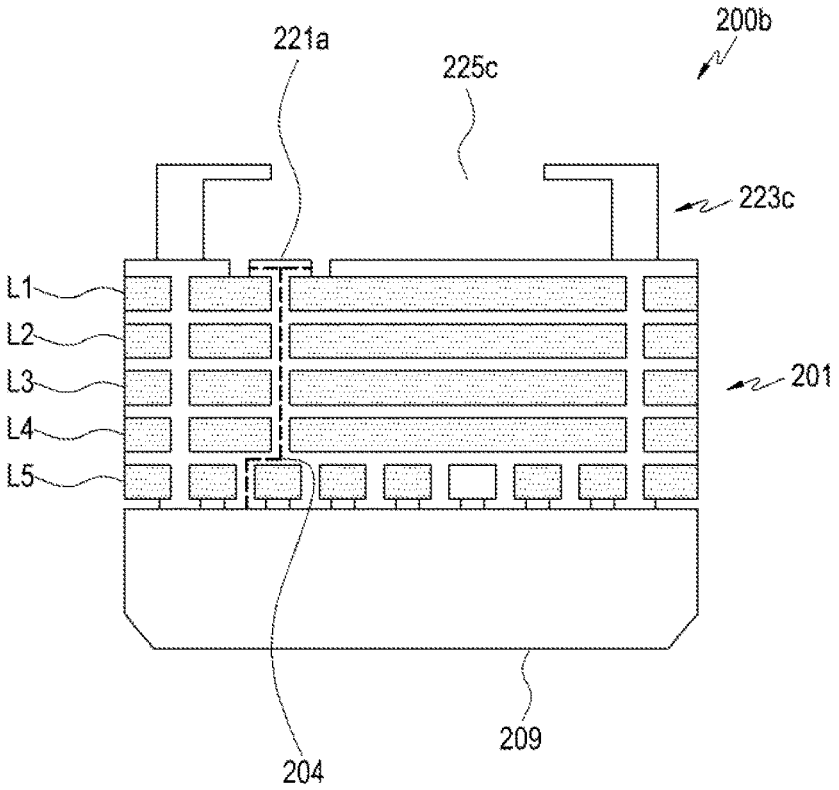
FIG. 10 is a sectional view for explaining yet another example in which a radiation conductor and a dummy conductor are arranged in an antenna device according to one of various embodiments of the present disclosure.

FIG. 10 is a sectional view for explaining yet another example in which a radiation conductor and a dummy conductor are arranged in an antenna device 200*b* according to one of various embodiments of the present disclosure.

Referring to FIGS. 9 and 10, the antenna device 200*a*, 200*b* according to this embodiment may include: at least one first radiation conductor 221*a* disposed on one surface of an antenna substrate 201; and a first dummy conductor 223*c* mounted on the surface of the antenna substrate 201.

The antenna substrate 201 may be a multi-layer circuit board that includes multiple layers L1, L2, L3, L4, L5, and electrically conductive pattern(s) may be formed between the layers L1, L2, L3, L4, L5. The electrically conductive patterns may form, for example, a feeding line 204 that connects a radio frequency module 209 and the first radiation conductor(s) 221*a*.

The first radiation conductor(s) 221*a* may have the form of a plate-shaped radiation patch and may be arranged in a specified area on the surface of the antenna substrate 201. The first dummy conductor 223*c* may have a cover shape that covers the area in which the first radiation conductor(s) 221*a* are arranged, and may include aperture(s) 225*c* that correspond to the first radiation conductor(s) 221*a*.

When the first dummy conductor 223*c* is mounted on the surface of the antenna substrate 201, a space may be formed inside the first dummy conductor 223*c*. The space formed inside the first dummy conductor 223*c* may be exposed through the aperture(s) 225*c* in the direction of the surface of the antenna substrate 201. According to various embodiments, the first dummy conductor 223*c* may be mounted on the surface of the antenna substrate 201 to form an aperture antenna structure. In the case where the first dummy conductor 223*c* is mounted on the antenna substrate 201 to form an aperture antenna structure, the first radiation conductor(s) 221*a* may be used as a feeding pad that is connected to the radio frequency module 209 to transfer a feeding signal.

Figure 11:
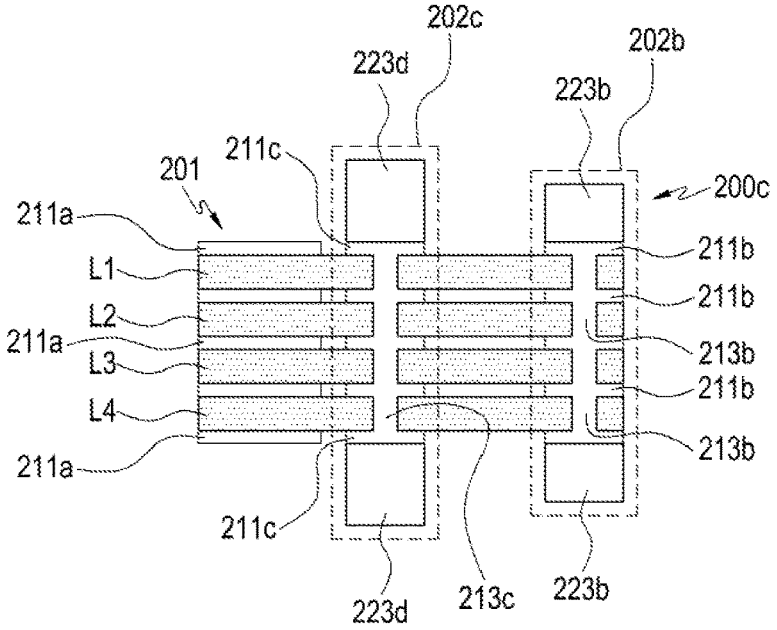
FIG. 11 is a sectional view for explaining yet another example in which a radiation conductor and a dummy conductor are arranged in an antenna device according to one of various embodiments of the present disclosure.

FIG. 11 is a sectional view for explaining yet another example in which a radiation conductor and a dummy conductor are arranged in an antenna device 200*c* according to one of various embodiments of the present disclosure.

Referring to FIG. 11, the antenna device 200*c* may further include: a second radiation unit 202*b* arranged on the edge of an antenna substrate 201; and a third radiation unit 202*c* disposed adjacent to the second radiation unit 202*b*. For example, the third radiation unit 202*c* may have a structure similar to that of the second radiation unit 202*b* and may interact with the second radiation unit 202*b* to transmit and receive radio signals.

The antenna substrate 201 may be a multi-layer circuit board constituted by multiple layers L1, L2, L3, L4, L5, and electrically conductive patterns 211*a*, 211*b*, 211*c* may be disposed between the layers L1, L2, L3, L4, L5. The electrically conductive patterns 211*a*, 211*b*, 211*c* disposed on the different layers L1, L2, L3, L4 may be electrically connected with each other through via holes formed in the respective layers L1, L2, L3, L4 and/or electrical conductors 213*b*, 213*c* with which the via holes are filled.

The second radiation unit 202*b* may include a second radiation conductor constituted by a combination of a part of the electrically conductive patterns 211*a*, 211*b*, 211*c* (e.g., the electrically conductive pattern indicated by reference numeral 211*b*) and a part of the electrical conductors 213*b*, 213*c* (e.g., the electrical conductor indicated by reference numeral 213*b*) with which the via holes are filled. The third radiation unit 202*c* may include a third radiation conductor constituted by a combination of another part of the electrically conductive patterns 211*a*, 211*b*, 211*c* (e.g., the electrically conductive pattern indicated by reference numeral 211*c*) and another part of the electrical conductors 213*b*, 213*c* (e.g., the electrical conductor indicated by reference numeral 213*c*) with which the via holes are filled. The second and third radiation conductors may be disposed within the antenna substrate 201, and a part of each radiation conductor may be exposed to the outside of the antenna substrate 201. For example, a part of each of the electrically conductive patterns 211*b*, 211*c*, which constitute the second and third radiation conductors, may be exposed through one surface and/or opposite surfaces of the antenna substrate 201.

The second and third radiation units 202*b*, 202*c* may include dummy conductors 223*b*, 223*d* mounted on the antenna substrate 201, respectively. The dummy conductors 223*b*, 223*d* may be mounted on the parts of the second and third radiation conductors that are exposed to the outside of the antenna substrate 201. According to various embodiments, different parts of each of the second and third radiation conductors may be exposed through the opposite surfaces of the antenna substrate 201, and the dummy conductors 223*b*, 223*d* may be mounted on the exposed parts of the second and third radiation conductors.

The radiation conductor of the antenna device(s) described above may be disposed on the surface of the antenna substrate and/or within the circuit board to generate an electromagnetic field within the antenna substrate when transmitting and receiving radio signals. For example, an electromagnetic field is generated within the antenna substrate, which may cause a dielectric loss or a loss due to heat generation. The antenna device, according to various embodiments of the present disclosure, may generate an electromagnetic field outside the circuit board (e.g., in the air) since the dummy conductors disposed outside the antenna substrate are electrically connected with the radiation conductors. Accordingly, the performance of the antenna device may be enhanced by virtue of an improvement in a dielectric loss or a loss due to heat generation. In addition, a process of disposing the dummy conductors may be simplified through the surface mounting technology, and an increase in space required to constitute the antenna device may be restricted using the dummy conductors that are disposed in a lower position than, and/or at the same height as, an integrated circuit chip mounted on the antenna substrate.

Table 1 below shows measurement results on frequency variations and antenna gains before and after the mounting of the dummy conductors 223*b*, 223*d* in a case where the antenna device 200*c* operates as a vertically polarized antenna.

TABLE 1

| | Before mounting of dummy conductor | After mounting of dummy conductor | Variation between before and after mounting |
|---|---|---|---|
| Resonant frequency [GHz] | 93 | 75 | −18 |
| Antenna gain [dBi] | 5.5 | 6.9 | +1.4 |
| Radiation efficiency [%] | 75 | 83 | +8 |

In a case where vertically polarized waves are formed using the radiation conductors disposed within the antenna substrate 201, a stable resonant frequency or radiation efficiency is less likely to be obtained as the thickness of the antenna substrate 201 decreases. The antenna device, according to various embodiments of the present disclosure, may have an adjustable resonant frequency and may enhance the antenna gain or radiation efficiency, as represented in Table 1 above, by disposing the dummy conductors, which expand the electrical lengths and/or the ground area sizes of the radiation conductors, outside the antenna substrate.

The antenna device, according to various embodiments of the present disclosure, may expand the ground part or ground area that supplies reference potential for the radiation conductors, or may prevent interference between the adjacent radiation conductors, by mounting the dummy conductors on the ground conductors. For example, the antenna device, according to various embodiments of the present disclosure, includes the ground parts on which the dummy conductors are provided, thereby enhancing the radiation efficiency.

Figure 12:
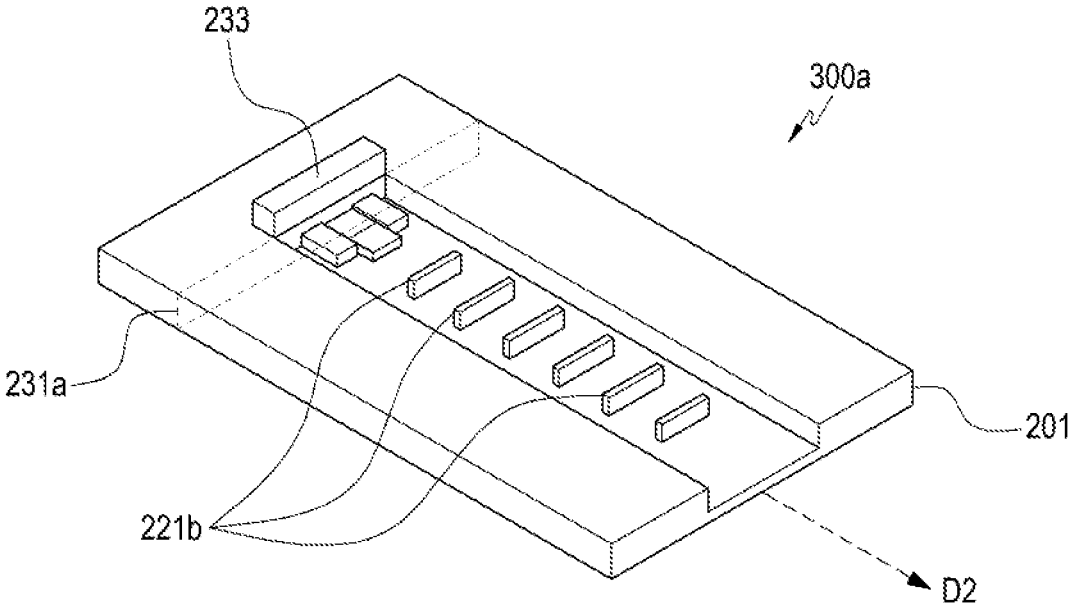
FIG. 12 is a perspective view illustrating an antenna device according to an embodiment of the present disclosure.

FIG. 12 is a perspective view illustrating an antenna device 300*a* according to an embodiment of the present disclosure.

Figure 13:
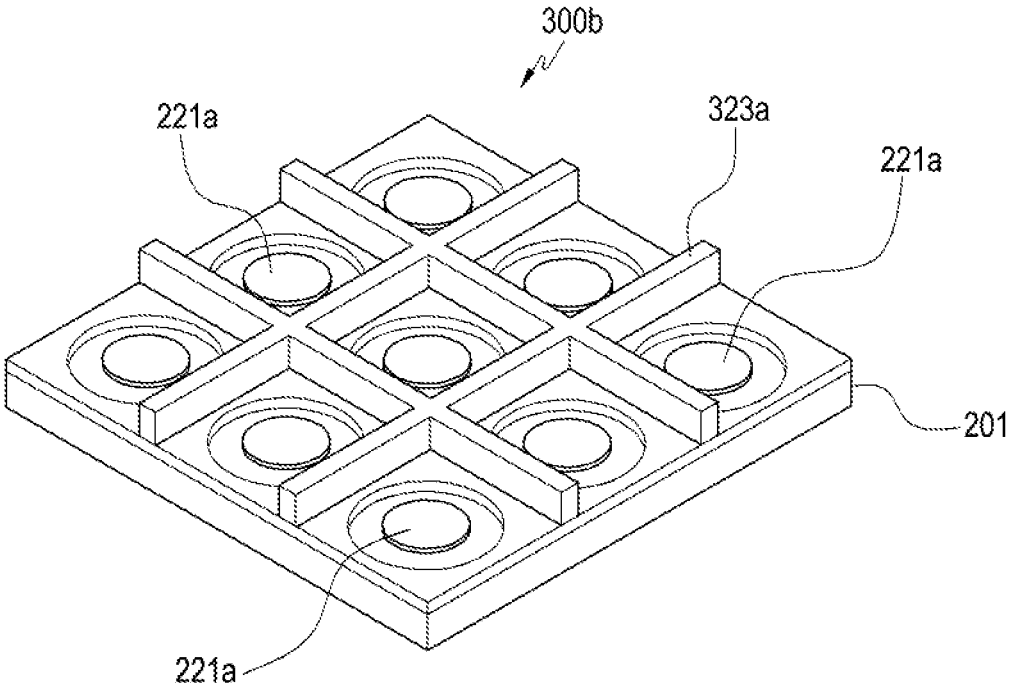
FIG. 13 is a perspective view illustrating an antenna device according to an embodiment of the present disclosure.

FIG. 13 is a perspective view illustrating an antenna device 300*b* according to an embodiment of the present disclosure.

The antenna device 300*a*, 300*b* may include radiation conductor(s) 221*a*, 221*b*, ground conductor(s) 231*a*, and dummy conductor(s) 233, 323*a*. The radiation conductor(s) 221*a*, 221*b* may be disposed on the surface of the antenna substrate 201 and/or within the circuit board 201*a*.

The ground conductor(s) 231*a* may be disposed in proper position(s) in the interior and/or on the exterior of the antenna substrate 201 according to the array, arrangement direction, shape, etc. of the radiation conductor(s) 221*a*, 221*b*. The dummy conductor(s) 233, 323*a* may be disposed on the exterior of the antenna substrate 201 and may be connected with the ground conductor 231*a*. For example, the dummy conductor(s) 233, 323*a* may form a ground part of the antenna device 300*a*, 300*b* together with the ground conductor 231*a* to supply reference potential for the radiation conductor(s) 221*a*, 221*b*. In a case where a plurality of radiation conductors 221*a* are disposed on the surface of the circuit board 201*a*, the dummy conductor 323*a* may provide a diaphragm structure disposed between the radiation conductors 221*a* as illustrated in FIG. 13 to electro-magnetically isolate the radiation conductors 221*a* from each other. The interference between the radiation conductors may be prevented by means of the arrangement of the dummy conductor(s) 323*a*, thereby enhancing the radiation efficiency (e.g., antenna gain) of the antenna device.

A configuration of connecting a dummy conductor with a ground conductor will be more specifically described with reference to FIG. 14.

Figure 14:
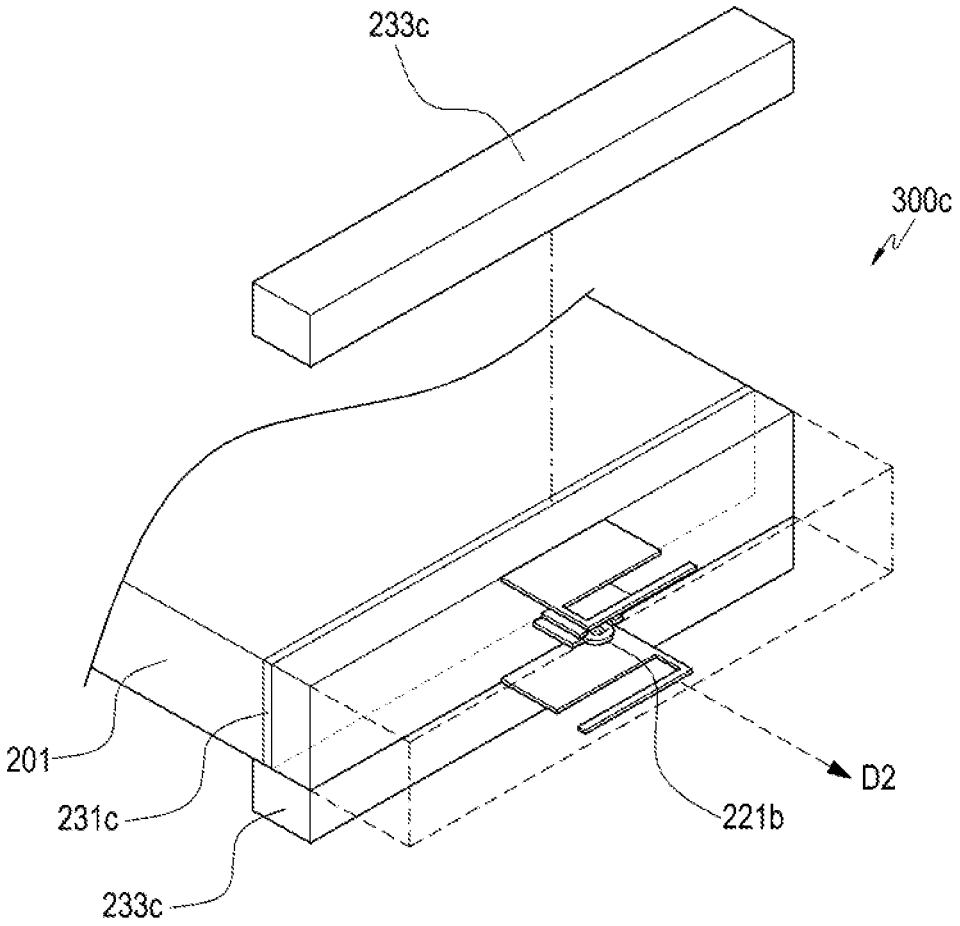
FIG. 14 is a perspective view illustrating an antenna device according to an embodiment of the present disclosure.

FIG. 14 is a perspective view illustrating an antenna device 300*c* according to an embodiment of the present disclosure.

Figure 15:
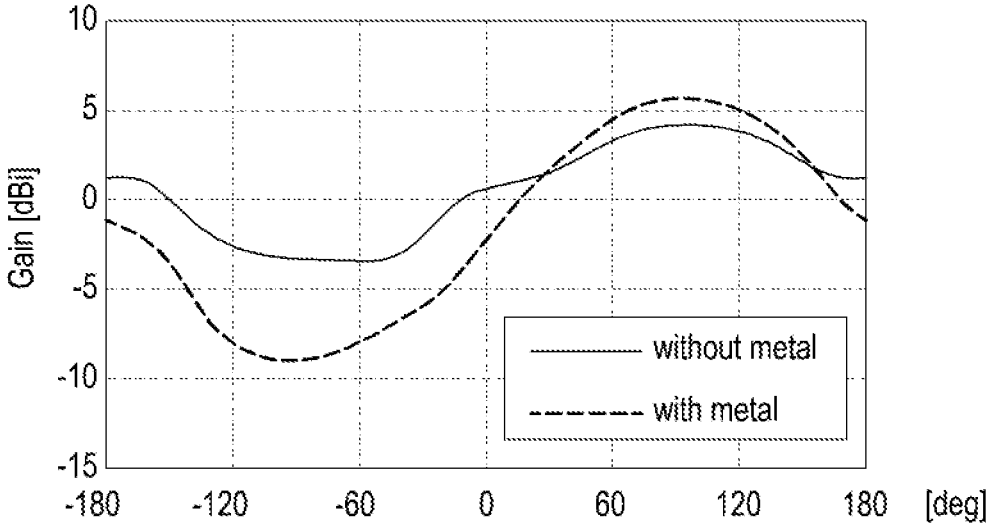
FIG. 15 is a graph for explaining the radiation efficiency of the antenna device according to the embodiment of the present disclosure illustrated in FIG. 14.

FIG. 15 is a graph for explaining the radiation efficiency of the antenna device 300*c* according to the embodiment of the present disclosure illustrated in FIG. 14.

Referring to FIG. 14, the antenna device 300*c* may include: a radiation conductor 221*b* constituted by a combination of a plurality of electrically conductive patterns disposed within an antenna substrate 201; a ground conductor 231*c* disposed within the antenna substrate 201 so as to be adjacent to the radiation conductor 221*b*; and a dummy conductor 233*c* mounted on at least one surface of the antenna substrate 201. At least a part of the ground conductor 231*c* may be exposed through one surface and/or an opposite surface of the antenna substrate 201, and the dummy conductor 233*c* may be mounted on the part of the ground conductor 231*c* that is exposed to the outside of the antenna substrate 201 through at least one surface of the antenna substrate 201. For example, the dummy conductor 233*c* may be electrically connected with the ground conductor 231*c* to contribute to expanding the ground part or ground area of the antenna device 300*c*.

The radiation conductor 221*b* may be located on one side edge of the antenna substrate 201 and may form an antenna that generates circularly polarized waves by a combination of the electrically conductive patterns formed on different layers of the antenna substrate 201. The radiation conductor 221*b* may be constituted by a combination of the electrically conductive patterns formed within the antenna substrate 201 and may be disposed within the antenna substrate 201. The shape or combination of the electrically conductive patterns constituting the radiation conductor 221*b* may be diversely implemented according to the operating frequency of the antenna device 300*c*, the size of the antenna substrate 201, the installation environment of the antenna substrate 201 in an electronic device (e.g., the above-described electronic device 100), and the like, and more detailed descriptions thereof will be omitted accordingly.

The ground conductor 231*c* may be constituted by a combination of the electrically conductive patterns disposed on the respective layers of the antenna substrate 201, via holes formed in the respective layers of the antenna substrate 201, and/or electrical conductors with which the via holes are filled. For example, the ground conductor 231*c* may be located within the antenna substrate 201 so as to be adjacent to the radiation conductor 221*b*. According to various embodiments, a part of the ground conductor 231*c* may be exposed through one surface and/or the opposite surface of the antenna substrate 201.

The dummy conductor 233*c* may be formed of an electrically conductive material and may be mounted on a part of the ground conductor 231*c* that is exposed to the outside of the antenna substrate 201 through at least one surface of the antenna substrate 201. For example, the dummy conductor 233*c* may be connected with the ground conductor 231*c* to expand the ground part (e.g., ground area) for the radiation conductor 221*b*. A radiation pattern of the antenna device 300*c* may be formed in a direction from the ground conductor 231*c* and/or the dummy conductor 233*c* to the radiation conductor 221*b*, for example, in a second direction D2. For example, the ground conductor 231*c* and/or the dummy conductor 233*c* may restrict the radiation of a radio signal in the direction opposite to the second direction D2 and may enhance the radiation power of a radio signal that is radiated in the second direction D2.

Referring to FIG. 15, it can be seen that the antenna gain is improved by about 2 dBi in the second direction D2 when the dummy conductor 233*c* is mounted ('with metal') compared to before the dummy conductor 233*c* is mounted ('without metal'), where the direction of about 90 degrees represents the second direction D2. In addition, it can be seen that the back lobe of the antenna device 300*c* is restricted by about 5 dBi when the dummy conductor 233*c* is mounted.

Figure 16:
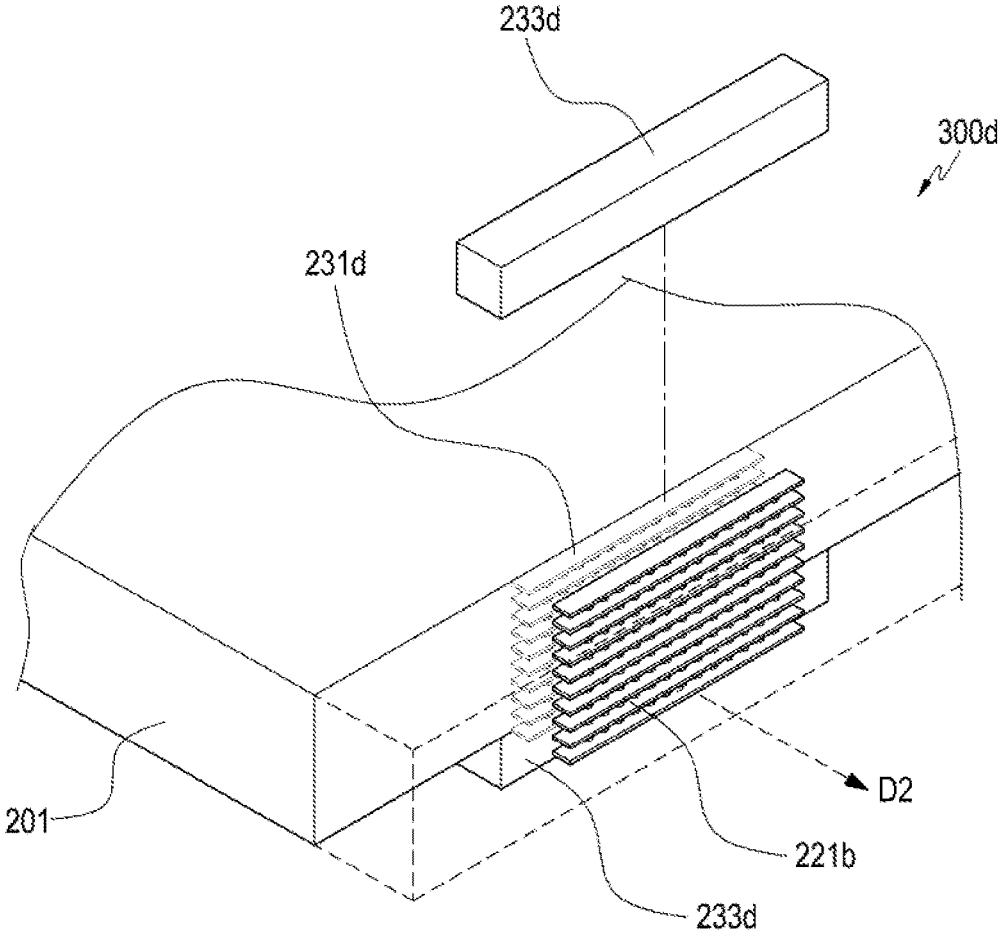
FIG. 16 is an exploded perspective view illustrating an antenna device according to an embodiment of the present disclosure.

FIG. 16 is an exploded perspective view illustrating an antenna device 300*d* according to an embodiment of the present disclosure.

Figure 17:
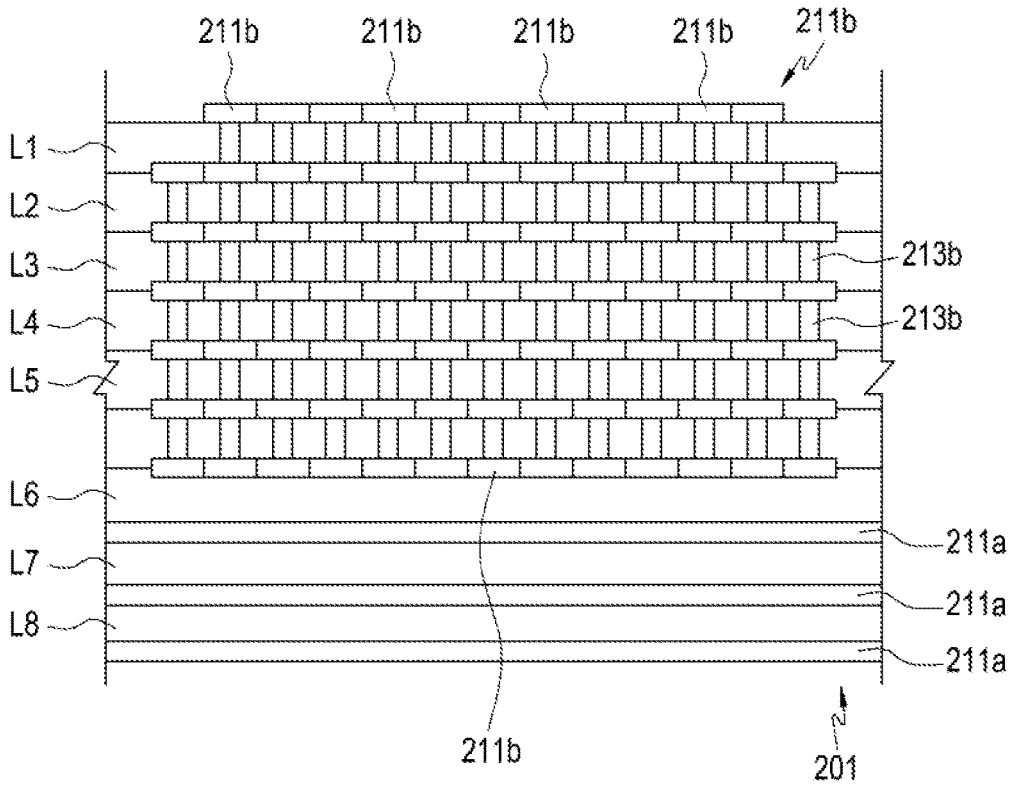
FIG. 17 is a front view illustrating a radiation conductor of the antenna device according to the embodiment of the present disclosure illustrated in FIG. 16.

FIG. 17 is a front view illustrating a radiation conductor of the antenna device 300*d* according to the embodiment of the present disclosure illustrated in FIG. 16.

Figure 18:
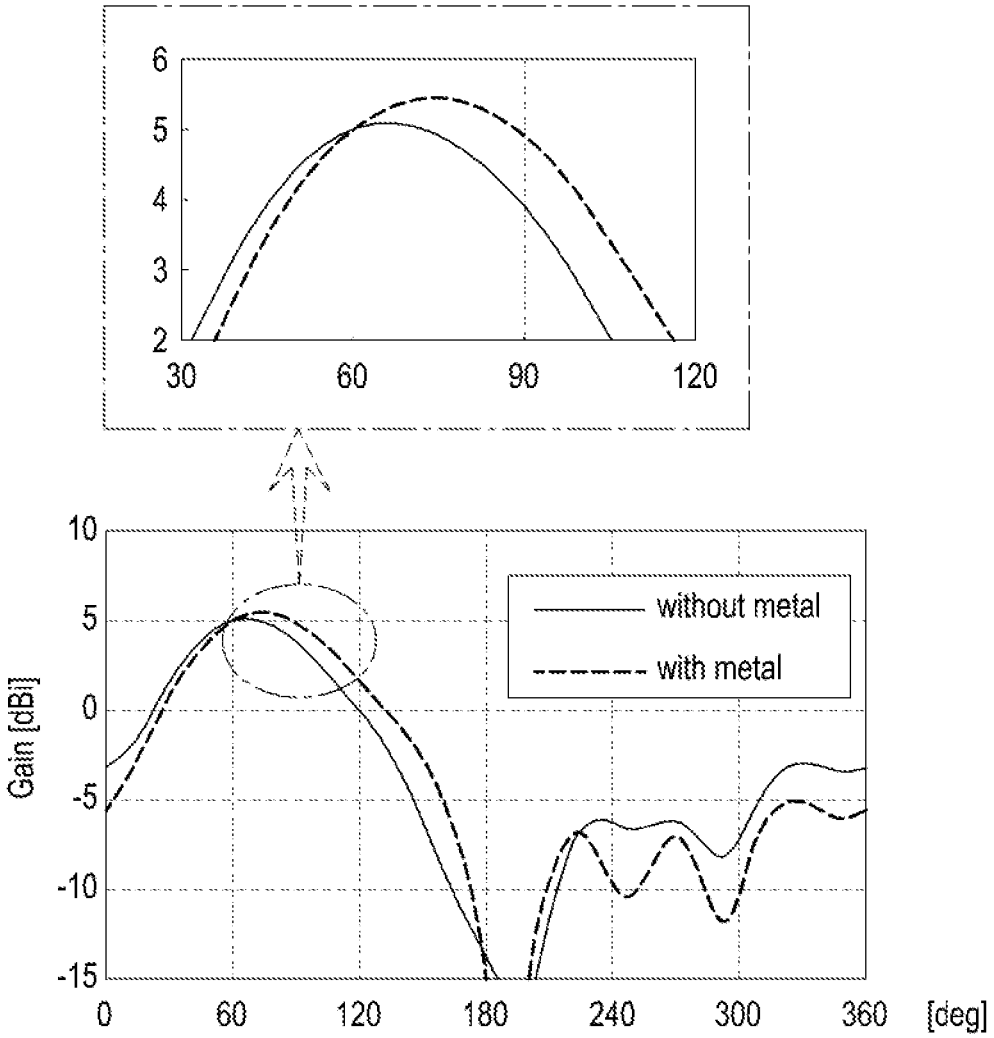
FIG. 18 is a graph for explaining the radiation efficiency of the antenna device according to the embodiment of the present disclosure illustrated in FIG. 16.

FIG. 18 is a graph for explaining the radiation efficiency of the antenna device 300*d* according to the embodiment of the present disclosure illustrated in FIG. 16.

Referring to FIGS. 16 and 17, the antenna device 300*d* may include a radiation conductor 221*b* and a ground conductor 233*d* that are embedded in an antenna substrate 201; and dummy conductor(s) 233*d* mounted on the exterior of the antenna substrate 201 and connected with the ground conductor 231*d*.

The radiation conductor 221*b* may be formed by a combination of electrically conductive patterns 211*a*, 211*b* formed on multiple layers L1, L2, L3, L4, L5, L6, L7, L8 that constitute the antenna substrate 201, via holes formed in the respective layers L1, L2, L3, L4, L5, L6, L7, L8 to connect the electrically conductive patterns 211*a*, 211*b*, and/or electrical conductors 213*b* with which the via holes are filled, and may form a horizontal radiation antenna. The dielectric material that makes up the antenna substrate 201 may be located between the electrically conductive patterns 211*b* and the electrical conductors 213*b* that constitute the radiation conductor 221*b*. However, since the intervals between the electrically conductive patterns 211*b* and the electrical conductors 213*b* are sufficiently small, the radiation conductor 221*b* may provide a patch structure for radio signals (e.g., mmWave) transmitted and received through the radiation conductor 221*b*. The radiation conductor 221*b* may be supplied with power from a radio frequency module (e.g., the above-described radio frequency module 209) through an interconnection wire (e.g., the above-described feeding line 204) that is provided on the antenna substrate 201.

Although not specifically illustrated, the ground conductor 231*d* may be formed by a combination of other electrically conductive patterns and electrical conductors formed on the antenna substrate 201, similarly to the radiation conductor 221*b*. The ground conductor 231*d* may be located within the antenna substrate 201 so as to be adjacent to the radiation conductor 221*b* and may supply reference potential for the radiation conductor 221*b*. According to various embodiments, the ground conductor 231*d* may have a larger size (e.g., a larger width and length) than the radiation conductor 221*b*.

The dummy conductor 233*d* may be formed of an electrically conductive material and may be mounted on the exterior of the antenna substrate 201 and connected with the ground conductor 231*d*. According to various embodiments, a part of the ground conductor 231*d* may be exposed through one surface and/or an opposite surface of the antenna substrate 201, and the dummy conductor 233*d* may be disposed on one surface and/or the opposite surface of the antenna substrate 201 and may be mounted on the exposed part of the ground conductor 231*d*.

A radio signal may be radiated through the arrangement of the radiation conductor 221*b*, the ground conductor 231*d*, and/or the dummy conductor 233*d* in the second direction D2.

Referring to FIG. 18, it can be seen that the antenna gain is improved by about 1.1 dBi in the direction of about 90 degrees, for example, in the second direction D2 when the dummy conductor 233*d* is mounted ('with metal') compared to before the dummy conductor 233*d* is mounted ('without metal'). In addition, it can be seen that the back lobe formed in the range of about 240 degrees to about 360 degrees is restricted.

Figure 19:
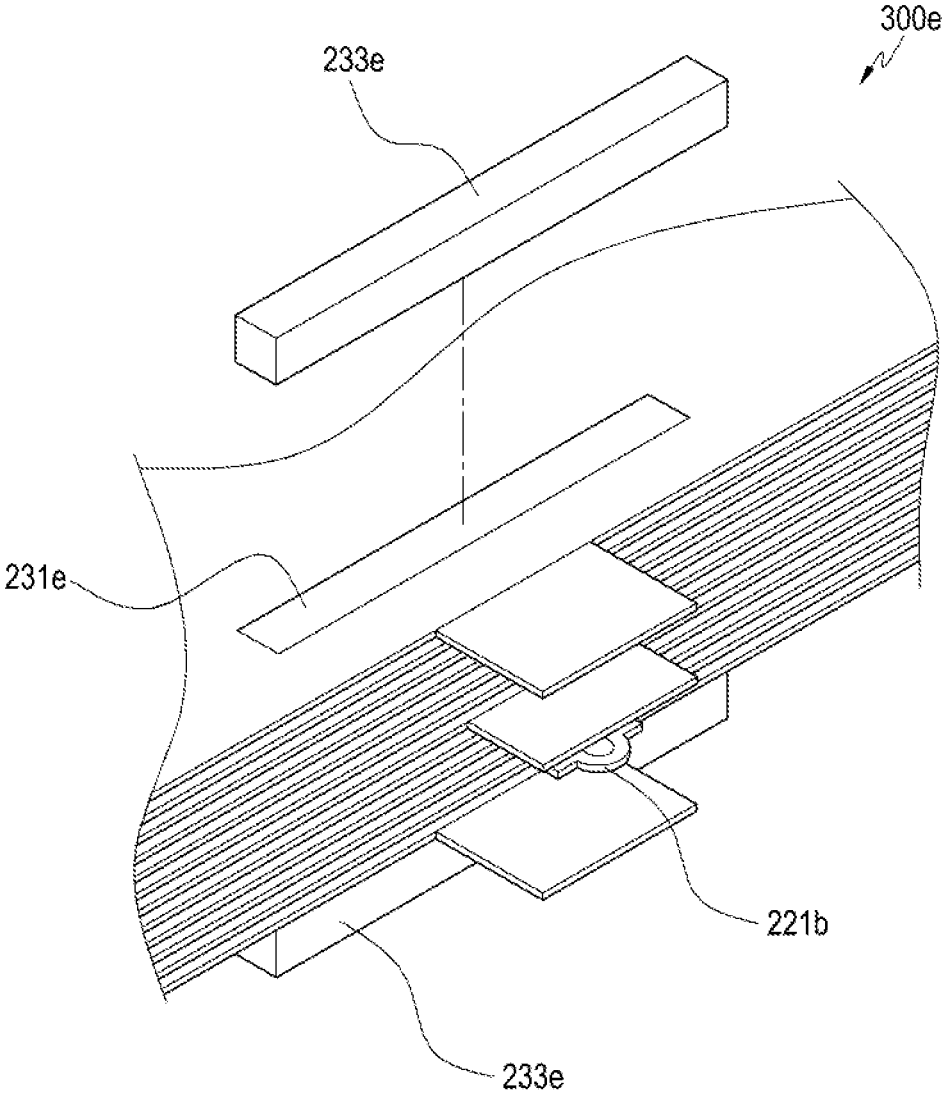
FIG. 19 is an exploded perspective view illustrating an antenna device according to an embodiment of the present disclosure.

FIG. 19 is an exploded perspective view illustrating an antenna device 300*e* according to an embodiment of the present disclosure.

Figure 20:
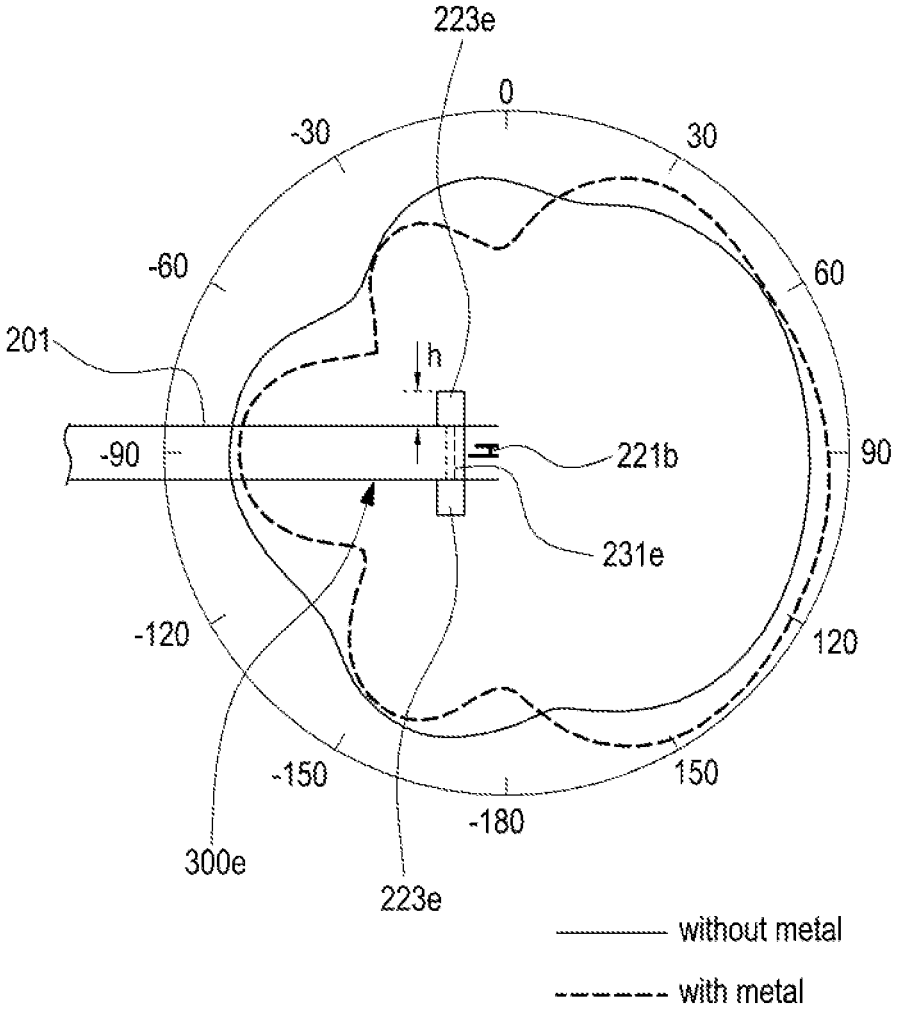
FIG. 20 is a graph for explaining the radiation efficiency of the antenna device according to the embodiment of the present disclosure illustrated in FIG. 19.

FIG. 20 is a graph for explaining the radiation efficiency of the antenna device 300*e* according to the embodiment of the present disclosure illustrated in FIG. 19.

In the manufacturing of an antenna for mmWave communication, omni-directionality may be easily ensured by diversely implementing circular polarization, vertical polarization, horizontal polarization, and the like in a single electronic device. A small and light electronic device may have difficulty in ensuring the sufficient height of a radiation conductor and/or a ground conductor for mmWave communication. For example, there may be difficulty in manufacturing a radiation conductor that implements vertical polarization since the thickness of a circuit board is restricted.

According to various embodiments of the present disclosure, an antenna device that forms vertical polarization may also be easily formed on a circuit board with a restricted thickness thanks to a dummy conductor that is mounted on the exterior of the circuit board to expand the electrical magnitude of a radiation conductor and/or a ground conductor.

Referring to FIGS. 19 and 20, the antenna device 300*e* may include: a radiation conductor 221*b* constituted by a combination of a plurality of electrically conductive patterns disposed within a multi-layer antenna substrate 201; a ground conductor 231*e* disposed within the antenna substrate 201 so as to be adjacent to the radiation conductor 221*b*; and a dummy conductor 233*e* mounted on at least one surface of the antenna substrate 201. At least a part of the ground conductor 231*e* may be exposed through one surface and/or an opposite surface of the antenna substrate 201, and the dummy conductor 233*e* may be mounted on the part of the ground conductor 231*e* that is exposed to the outside of the antenna substrate 201 through at least one surface of the antenna substrate 201. For example, the dummy conductor 233*e* may be electrically connected with the ground conductor 231*e* to contribute to expanding the ground part or ground area of the antenna device 300*e*.

The radiation conductor 221*b* may be located on one side edge of the antenna substrate 201 and may form an antenna that generates vertically polarized waves by a combination of the electrically conductive patterns formed on different layers of the antenna substrate 201. The radiation conductor 221*b* may be constituted by a combination of the electrically conductive patterns formed within the antenna substrate 201 and may be disposed within the antenna substrate 201. The shape or combination of the electrically conductive patterns constituting the radiation conductor 221*b* may be diversely implemented according to the operating frequency of the antenna device 300*e*, the size of the antenna substrate 201, the installation environment of the antenna substrate 201 in an electronic device, and the like, and more detailed descriptions thereof will be omitted accordingly.

The ground conductor 231*e* may be constituted by a combination of the electrically conductive patterns disposed on the respective layers of the antenna substrate 201, via holes formed in the respective layers of the antenna substrate 201, and/or electrical conductors with which the via holes are filled. For example, the ground conductor 231*e* may be located within the antenna substrate 201 so as to be adjacent to the radiation conductor 221*b*. According to various embodiments, a part of the ground conductor 231*e* may be exposed through one surface and/or the opposite surface of the antenna substrate 201.

The dummy conductor 233*e* may be formed of an electrically conductive material and may be mounted on the part of the ground conductor 231*e* that is exposed to the outside of the antenna substrate 201 through at least one surface of the antenna substrate 201. For example, the dummy conductor 233*e* may be connected with the ground conductor 231*e* to expand the ground area for the radiation conductor 221*b*. A radio signal radiation pattern of the antenna device 300*c* may be formed in a direction from the ground conductor 231*e* and/or the dummy conductor 233*e* to the radiation conductor 221*b*, for example, in a second direction D2. For example, a radio signal radiated from the radiation conductor 221*b* may be restricted in the direction in which the ground conductor 231*e* and/or the dummy conductor 233*e* are arranged, and may enhance the radiation power in the second direction D2.

Referring to FIG. 20, it can be seen that the antenna gain is improved by about 1.5 dBi in the direction of about 90 degrees, for example, in the second direction D2 when the dummy conductor 233*e* is mounted ('with metal') compared to before the dummy conductor 233*e* is mounted ('without metal'). In addition, it can be seen that the back lobe of the antenna device 300*e* is restricted when the dummy conductor 233*e* is mounted.

Figure 21:
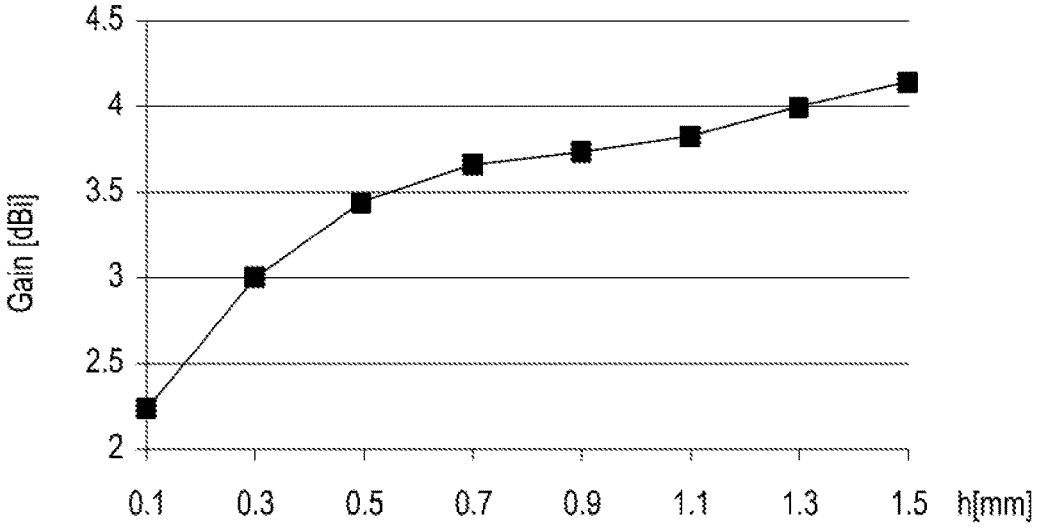
FIG. 21 is a graph for explaining a variation in the radiation efficiency of the antenna device, according to the height of a dummy conductor, according to the embodiment of the present disclosure illustrated in FIG. 19.

FIG. 21 is a graph for explaining a variation in the radiation efficiency of the antenna device 300*e* (shown in FIGS. 19 and 20), according to the variations in height h (shown in FIG. 20) of the dummy conductor 233*e*, according to the embodiment of the present disclosure illustrated in FIG. 19.

The dummy conductor 233*e* may be, for example, the dummy conductor illustrated in FIGS. 19 and 20, and the height h of the dummy conductor 233*e* may be the same as, or lower than, that of an integrated circuit chip mounted on the antenna substrate 201. The magnitude (e.g., height) of the ground area for the radiation conductor 221*b* may increase as the height h of the dummy conductor 233*e* increases. Furthermore, since the dummy conductor 233*e* is disposed on the exterior of the antenna substrate 201, the electromagnetic field generated by the antenna device 300*e* may be generated outside the antenna substrate 201. Accordingly, the dielectric loss of the antenna substrate 201 may be improved. FIG. 21 shows that the antenna gain gradually increases with an increase in the height of the dummy conductor 233*e*. In the actual manufacturing of an antenna device, the width or height of the ground area according to a combination of the ground conductor 231*e* and the dummy conductor 233*e* may be properly set in consideration of the operating frequency wavelength of the antenna device 300*e*.

Figure 22:
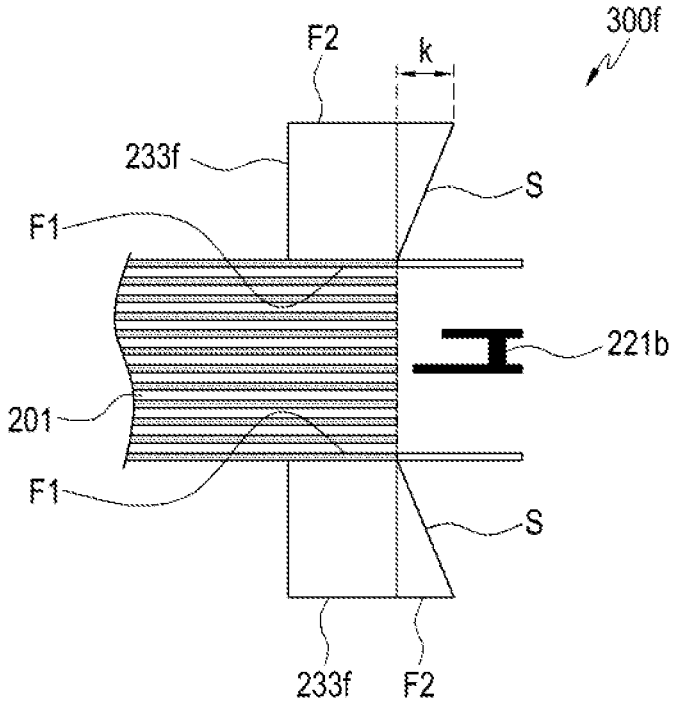
FIG. 22 is a sectional view illustrating an antenna device according to an embodiment of the present disclosure.

FIG. 22 is a sectional view illustrating an antenna device 300*f* according to an embodiment of the present disclosure.

Figure 23:
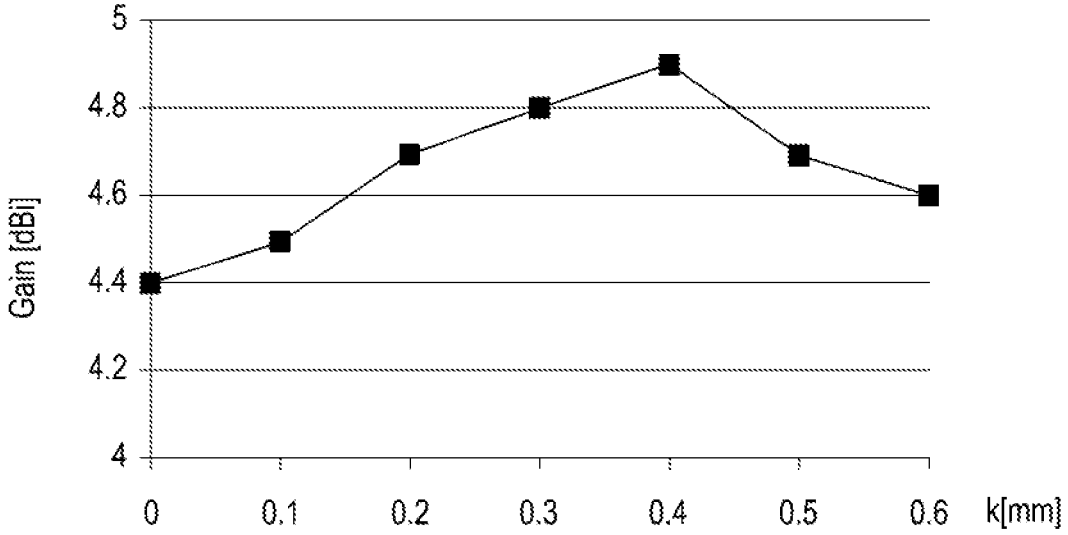
FIG. 23 is a graph for explaining a variation in the radiation efficiency of the antenna device, according to the specification of a dummy conductor, according to the embodiment of the present disclosure illustrated in FIG. 22.

FIG. 23 is a graph for explaining a variation in the radiation efficiency of the antenna device 300*f*, according to the specification of a dummy conductor, according to the embodiment of the present disclosure illustrated in FIG. 22.

According to various embodiments of the present disclosure, the dummy conductor 233*f* may be mounted on a ground conductor and may have a surface inclined with respect to the aiming direction of a radiation conductor 221*b* to enhance the gain of the antenna device 300*f*. The antenna device 300*f*, according to this embodiment, may have a structure similar to that of the antenna device 300*e* illustrated in FIG. 19 and may differ from the prior embodiment in terms of the shape of the dummy conductor 233*f*. Accordingly, in the following description of the antenna device 300*f*, according to this embodiment, structures similar to those of the antenna device 300*e* in the preceding embodiment may be provided with identical reference numerals, or reference numerals thereof may be omitted, and detailed descriptions thereof may also be omitted.

Referring to FIG. 22, the dummy conductor 233*f* may be formed of an electrically conductive material and may be mounted on a part of the ground conductor that is exposed to the outside of an antenna substrate 201 through at least one surface of the antenna substrate 201. For example, the dummy conductor 233*f* may be connected with the ground conductor to expand the ground area for the radiation conductor 221*b*. The dummy conductor 233*f* may include: a first surface F1 that faces one surface (or an opposite surface) of the antenna substrate 201; a second surface F2 that is opposite to the first surface F1; and a side surface S that connects the first and second surfaces F1, F2. According to various embodiments, the first and second surfaces F1, F2 may extend parallel to each other, and the side surface S may obliquely extend with respect to the first and/or second surface F1, F2, but the present disclosure is not limited thereto. The side surface S may be formed to be inclined or curved in a direction in which the side surface becomes closer to the radiation conductor 221*b* (e.g., in a direction toward the outside of the antenna substrate 201) with an approach to the second surface F2 from the first surface F1. For example, the dummy conductor 233*f* may form a reflection plate shape around the radiation conductor 221*b* together with the ground conductor disposed within the antenna substrate 201 as the dummy conductor 233*f* is mounted. For example, the dummy conductor 233*f* that includes the side surface S inclined with respect to the antenna substrate 201 may be mounted to enhance the horizontal radiation efficiency of the antenna device 300*f*.

FIG. 23 shows a variation in the antenna gain according to the slope of the side surface S of the dummy conductor 233*f*, for example, according to a difference k (shown in FIG. 22) in the width (or area) between the first surface F1 and the second surface F2. For example, the antenna gain is measured to be about 4.4 dBi when there is no width difference k between the first and second surfaces F1, F2 and to be about 4.9 dBi when there is a width difference k of 0.4 mm between the first and second surfaces F1, F2. For example, an inclined or curved surface may be formed in the side surface S of the dummy conductor 233*f* so as to be directed toward the radiation conductor 221*b*, which may enhance the antenna gain.

Referring again to FIGS. 21 and 23, the antenna gain may increase with an increase in the height of the dummy conductor 233*e*, 233*f*, but may show a different tendency according to the slope of the side surface (e.g., the width difference k between the first and second surfaces F1, F2). For example, the antenna gain may be proportional to the slope to a certain slope, but may be inversely proportional to the slope in a different slope range. Accordingly, if the side surface of the dummy conductor 233*e*, 233*f* is formed to be inclined and/or curved, the slope of the dummy conductor 233*f* may be properly designed in consideration of the radiation angle range and aiming direction of a radio signal radiated through the antenna device 300*e*, 300*f*, the position of the dummy conductor relative to the radiation conductor, and the like.

Figure 24:
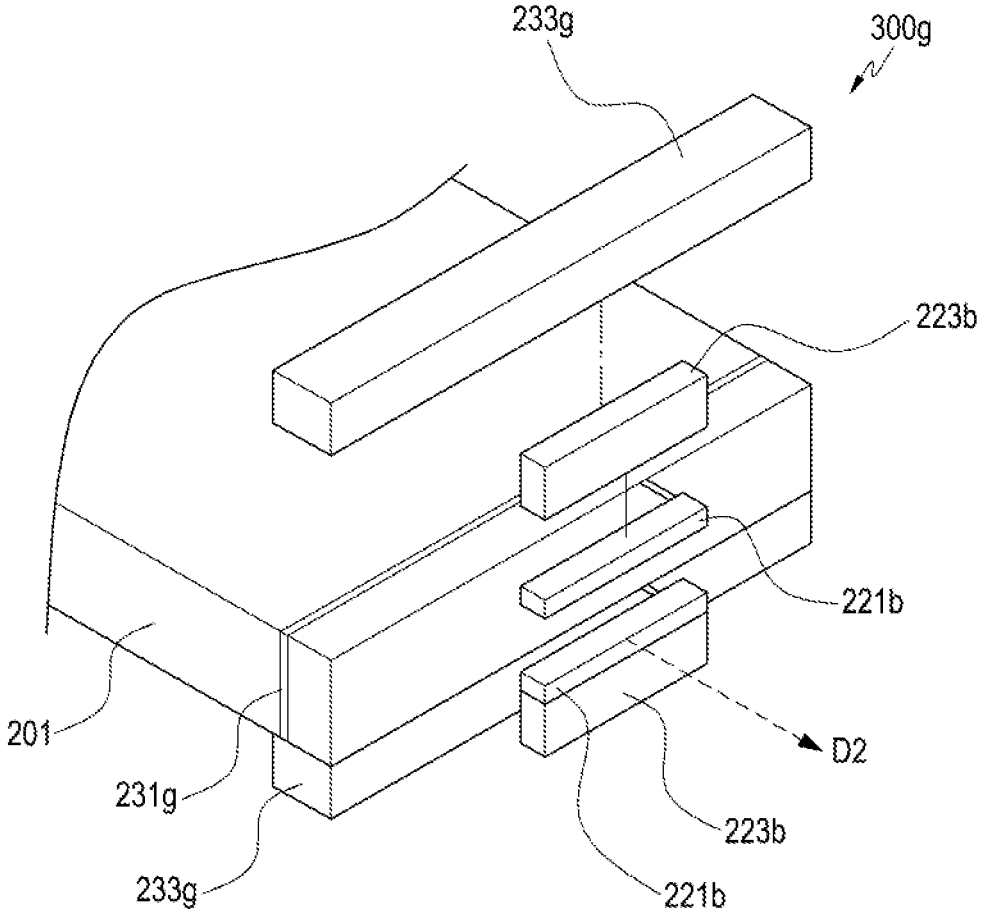
FIG. 24 is an exploded perspective view illustrating an antenna device according to an embodiment of the present disclosure.

FIG. 24 is an exploded perspective view illustrating an antenna device 300*g* according to an embodiment of the present disclosure.

Figure 25:
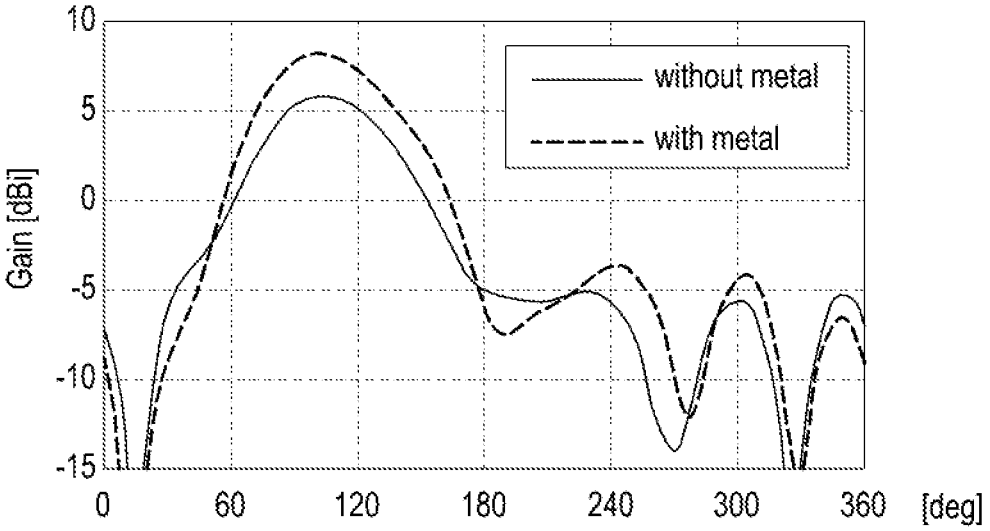
FIG. 25 is a graph for explaining the radiation efficiency of the antenna device according to the embodiment of the present disclosure illustrated in FIG. 24.

FIG. 25 is a graph for explaining the radiation efficiency of the antenna device 300*g* according to the embodiment of the present disclosure illustrated in FIG. 24.

Figure 26:
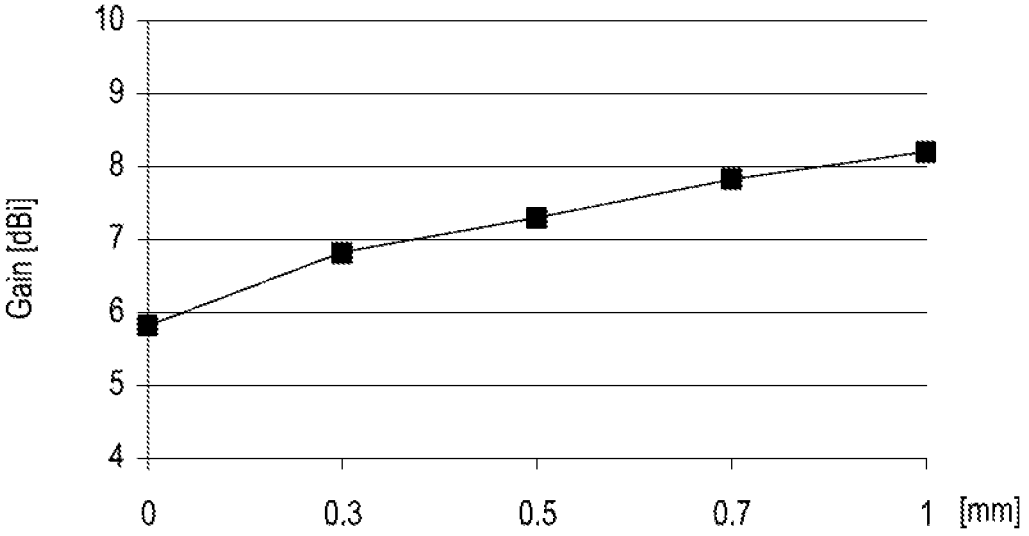
FIG. 26 is a graph for explaining a variation in the radiation efficiency of the antenna device, according to the height of a dummy conductor, according to the embodiment of the present disclosure illustrated in FIG. 24.

FIG. 26 is a graph for explaining a variation in the radiation efficiency of the antenna device 300*g*, according to the height of a dummy conductor, according to the embodiment of the present disclosure illustrated in FIG. 24.

Referring to FIG. 24, the antenna device 300*g* may include at least one radiation conductor 221*b* disposed on a side surface of an antenna substrate 201; a ground conductor 231*g* disposed within the antenna substrate 201; and a plurality of dummy conductors 223*b*, 233*g* mounted on the exterior of the antenna substrate 201.

The radiation conductor 221*b* may be provided on the side surface of the antenna substrate 201 and may be supplied with power from a radio frequency module through a feeding line formed on the antenna substrate 201. According to various embodiments, one pair of radiation conductors 221*b* may be disposed on the side surface of the antenna substrate 201 so as to be adjacent to each other.

The ground conductor 231*g* may be constituted by a combination of a plurality of electrically conductive patterns and via holes within the antenna substrate 201. Since the structure of the ground conductor has been described in the above embodiments, a more detailed description of the specific structure of the ground conductor 231*g* will be omitted. A part of the ground conductor 231*g* may be exposed through one surface and/or an opposite surface of the antenna substrate 201.

The dummy conductors 223*b*, 233*g* may be mounted to make contact with the radiation conductors 221*b* and/or a part of the ground conductor 231*g* exposed through the opposite surfaces of the antenna substrate 201. For example, the dummy conductors 223*b*, 233*g* may expand the electrical length of the antenna formed by the radiation conductor 221*b* and/or the size of the ground area formed by the ground conductor 231*g*.

The radiation conductor 221*b* may radiate a radio signal in the lateral direction of the antenna substrate 201, for example, in a second direction D2.

Referring to FIG. 25, it can be seen that the antenna gain is improved by about 2.4 dBi in the second direction D2 (e.g., in the direction of 90 degrees) when the dummy conductors 223*b*, 233*g* are mounted compared to before the dummy conductors 223*b*, 233*g* are mounted ('without metal') and the back lobe is restricted. In addition, referring to FIG. 26, it can be seen that the antenna gain gradually increases in proportion to the heights of the dummy conductors 223*b*, 233*g*.

As described above, the antenna device, according to various embodiments of the present disclosure, may include: the radiation conductor(s) disposed within the circuit board, on one surface of the circuit board, and/or a side surface of the circuit board; the ground conductor(s) disposed adjacent to the radiation conductor; and the dummy conductor(s) mounted on the radiation conductor and/or the ground conductor. The above-described dummy conductor may be formed at the same height as, or in a lower position than, an integrated circuit chip disposed on the circuit board and may expand the electrical length of the radiation conductor and/or the size of the ground area provided by the ground conductor. For example, the dummy conductor may expand the electrical length and/or ground area of the radiation conductor in the area occupied by the circuit board, thereby enhancing the performance of the antenna device. In addition, an electromagnetic field may be formed in the air (e.g., outside the circuit board) through the dummy conductor disposed on the exterior of the circuit board, thereby improving the dielectric loss caused by the circuit board.

Figure 27:
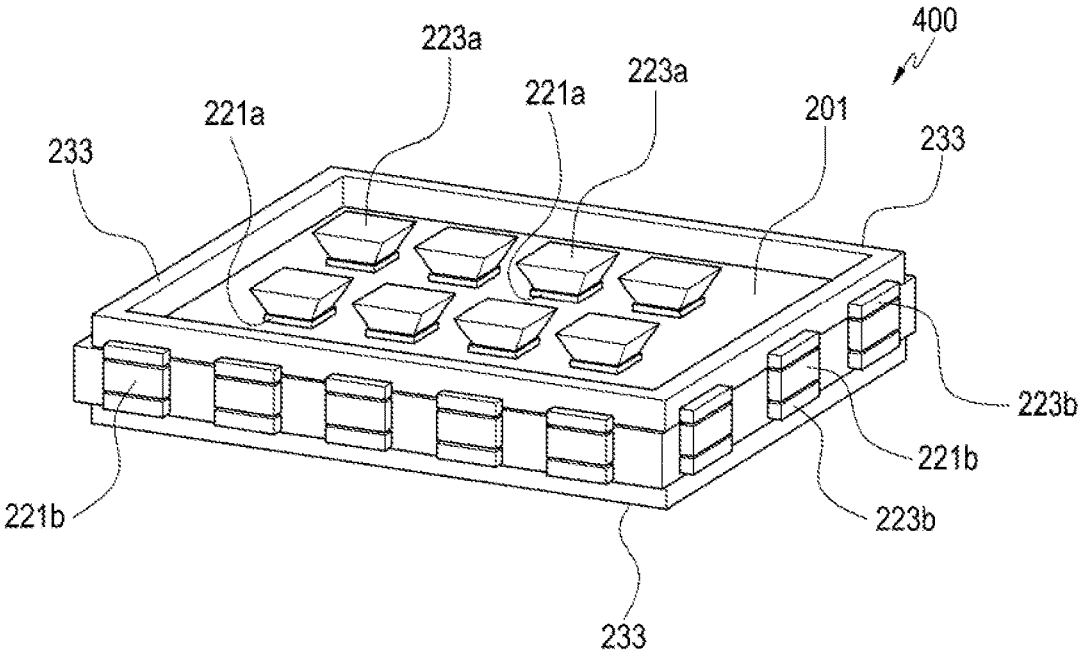
FIG. 27 is a perspective view illustrating an antenna device according to an embodiment of the present disclosure.

FIG. 27 is a perspective view illustrating an antenna device 400 according to an embodiment of the present disclosure.

Figure 28:
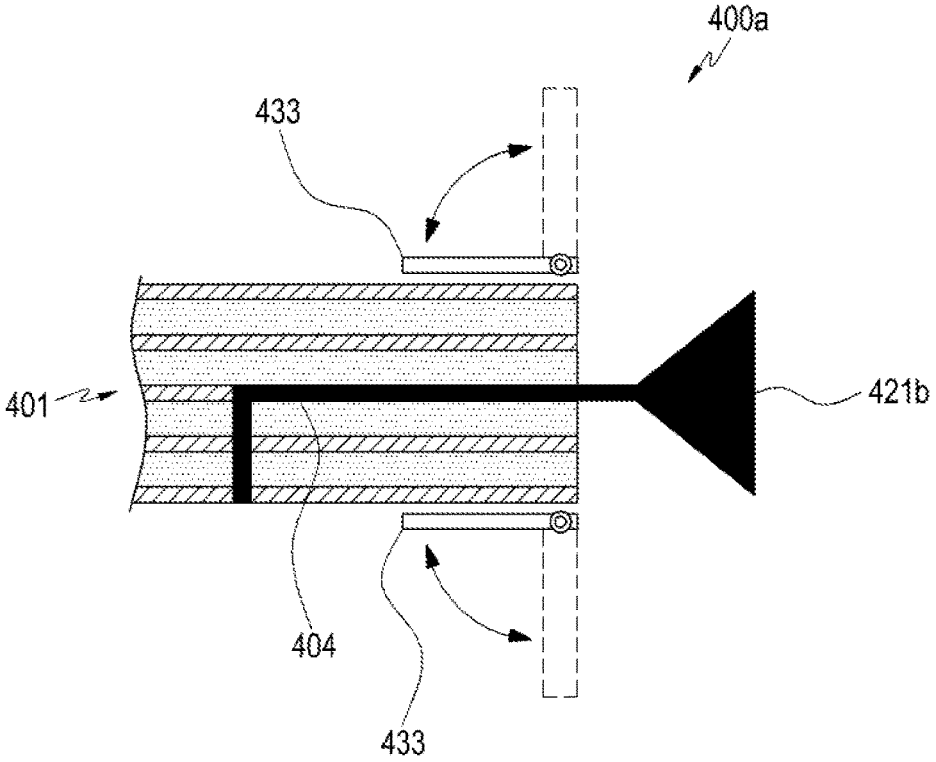
FIG. 28 is a sectional view illustrating an antenna device according to an embodiment of the present disclosure.

FIG. 28 is a sectional view illustrating an antenna device 400*a* according to an embodiment of the present disclosure.

FIGS. 27 and 28 illustrate applications of the antenna devices according to the above-described embodiments. FIG. 27 illustrates the antenna device 400 that includes: radiation conductors 221*b* disposed within an antenna substrate 201 or on one surface (or opposite surfaces) and/or side surfaces of the antenna substrate 201; and dummy conductors 223*a*, 223*b* mounted on the radiation conductors 221*a*, 221*b*, respectively. According to various embodiments, the antenna substrate 201 may include a ground conductor disposed therein, and a second dummy conductor 233 may be mounted on one surface and/or an opposite surface of the antenna substrate 201 to expand the ground area formed by the ground conductor within the antenna substrate 201. The radiation angle range and antenna gain of the antenna device 400 may be enhanced and the back lobe may be restricted by means of the arrangement of the dummy conductor(s) 223*a*, 223*b*, 233.

FIG. 28 discloses the antenna device 400*a* that includes: a radiation conductor 421*b* disposed on a side surface of a circuit board 401 and supplied with a feeding signal through a feeding line 404; and a dummy conductor 433 rotatably disposed on one surface and/or an opposite surface of the antenna substrate 401. The dummy conductor 433 may be driven by a micro electro mechanical systems (MEMS) to rotate a position close to one surface and/or the opposite surface of the antenna substrate 401 to an upright position. For example, the radiation direction and antenna gain of the antenna device 400*a* may be adjusted according to whether the dummy conductor 433 is in an upright state. For example, even though one radiation conductor 421*b* is disposed on the antenna substrate 401, radio signals may be radiated in diverse directions.

Figure 29:
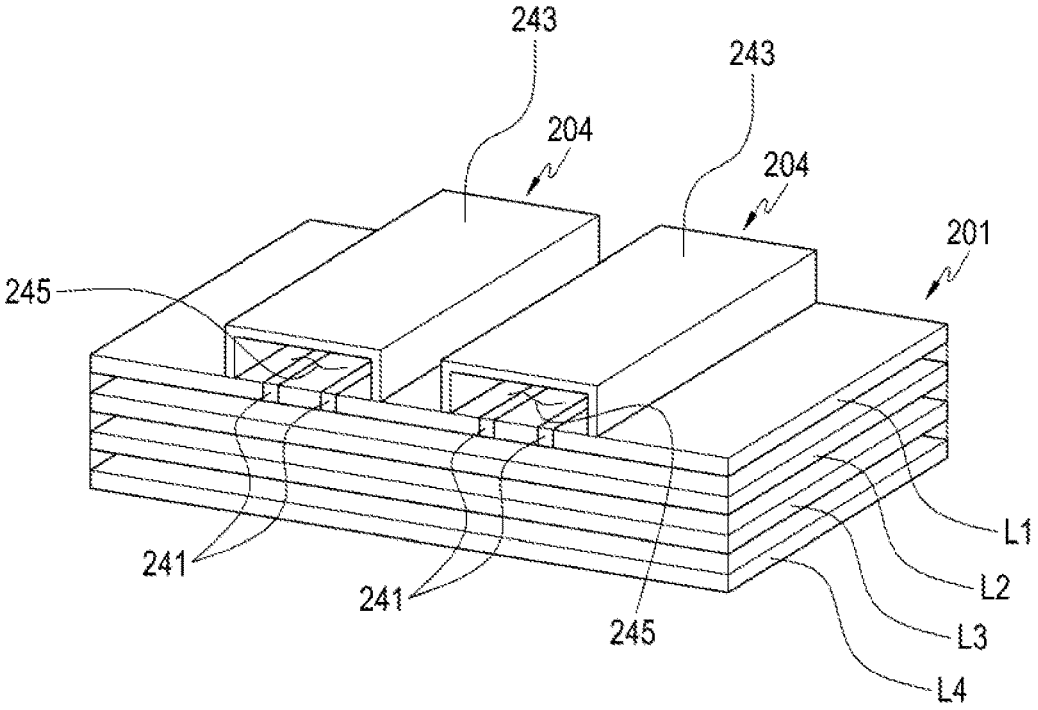
FIG. 29 is a perspective view illustrating a part of an antenna device according to an embodiment of the present disclosure.

FIG. 29 is a perspective view illustrating a part of an antenna device according to an embodiment of the present disclosure.

Figure 30:
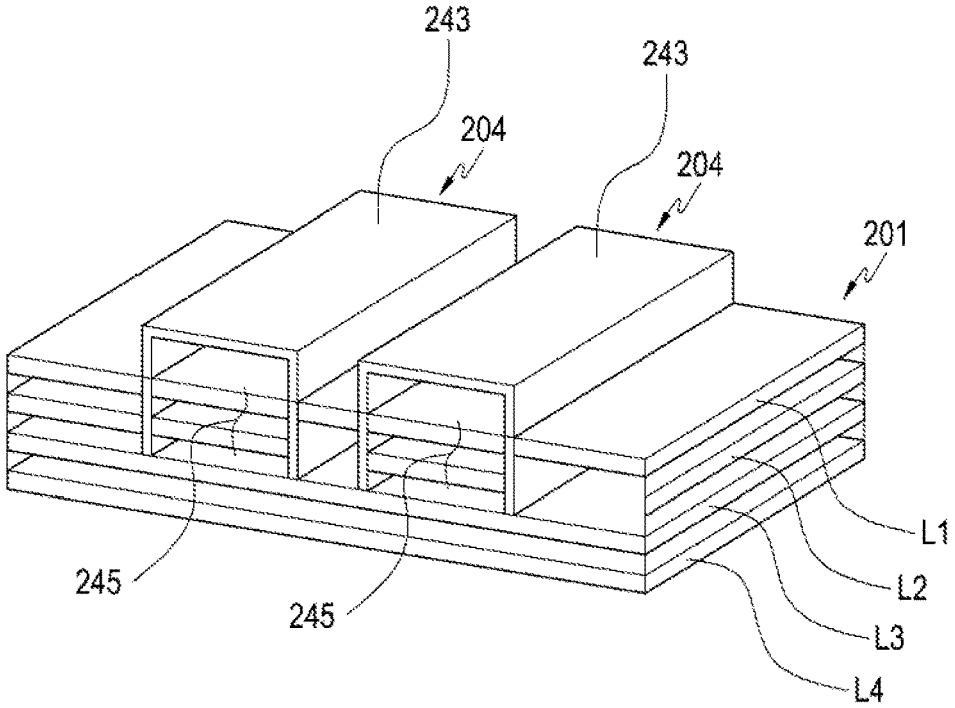
FIG. 30 is a perspective view illustrating a part of an antenna device according to an embodiment of the present disclosure.

FIG. 30 is a perspective view illustrating a part of an antenna device according to an embodiment of the present disclosure.

Figure 31:
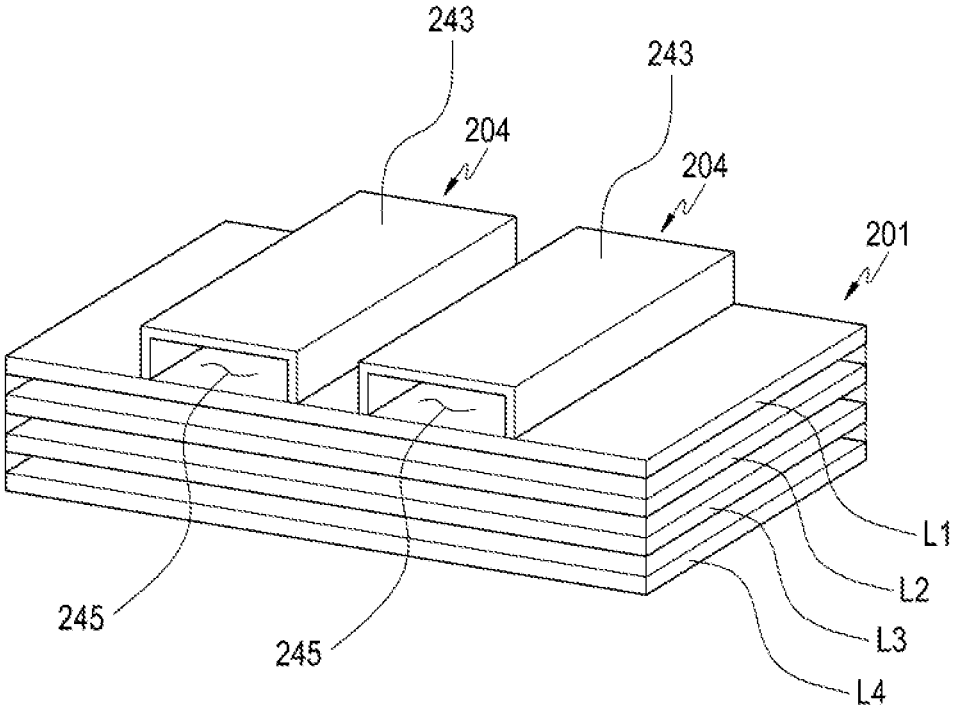
FIG. 31 is a perspective view illustrating a part of an antenna device according to an embodiment of the present disclosure.

FIG. 31 is a perspective view illustrating a part of an antenna device according to an embodiment of the present disclosure.

The antenna device, according to various embodiments of the present disclosure, may include: a printed circuit pattern 241; and a feeding line 204 formed of a dummy conductor 243 that is disposed adjacent to the printed circuit pattern 241 and/or is disposed to surround the area where the printed circuit pattern 241 is disposed. According to various embodiments, at least a part of the printed circuit pattern 241 that forms the feeding line 204 may be disposed on the surface of an antenna substrate 201. When a part of the printed circuit pattern 241 is disposed on the surface of the antenna substrate 201, a dielectric loss due to the antenna substrate 201, a radiation loss due to a leakage current or the printed circuit pattern 241 itself, and the like may be generated. Furthermore, when two different portions of the printed circuit pattern 241 and/or two different printed circuit patterns 241 are disposed adjacent to each other, a loss due to electromagnetic coupling may be generated. The dummy conductor 243 may be disposed on one surface of the antenna substrate 201 to surround a part and/or the entirety of the area where the printed circuit pattern 241 is formed. When two different portions of the printed circuit pattern 241 are located parallel to each other on one surface of the antenna substrate 201, or when two different printed circuit patterns 241 are disposed adjacent to each other, a plurality of dummy conductors 243 may be mounted on the surface of the antenna substrate 201.

According to various embodiments, since the dummy conductor 243 is mounted to surround the area where the printed circuit pattern 241 is formed, the printed circuit pattern 241 may be electro-magnetically shielded from different circuits or interconnection wires. For example, even though two different portions of the printed circuit pattern 241 or two different printed circuit patterns 241 are located adjacent to each other, the independent operating characteristics thereof may be maintained. According to an embodiment, a radiation loss due to a leakage current or the printed circuit pattern 241 itself may also be restricted in the internal space of the dummy conductor 243 and transferred to the radiation conductor. For example, the area where the printed circuit pattern 241 is formed and the space surrounded by the dummy conductor 243 may form a feeding waveguide 245. Accordingly, the signal power lost by the arrangement of the printed circuit pattern 241 may be transferred to the radiation conductor through the waveguide structure (e.g., the feeding waveguide 245) that is formed by the dummy conductor 243, thereby improving the feeding loss.

According to various embodiments, the feeding waveguide 245, as illustrated in FIG. 29, may be formed on the surface of the antenna substrate 201 on which the printed circuit pattern 241 is formed. According to an embodiment, as illustrated in FIG. 30, the antenna substrate 201 may be formed of a multi-layer circuit board, and the feeding waveguide 245 may be formed by a part of the internal space of the antenna substrate 201 along with the space formed by the dummy conductor 243. According to an embodiment, as illustrated in FIG. 31, the dummy conductor 243 may be mounted on the surface of the antenna substrate 201 on which no printed circuit pattern is formed so that the waveguide 245 may be formed on the surface of the antenna substrate 201.

Figure 32:
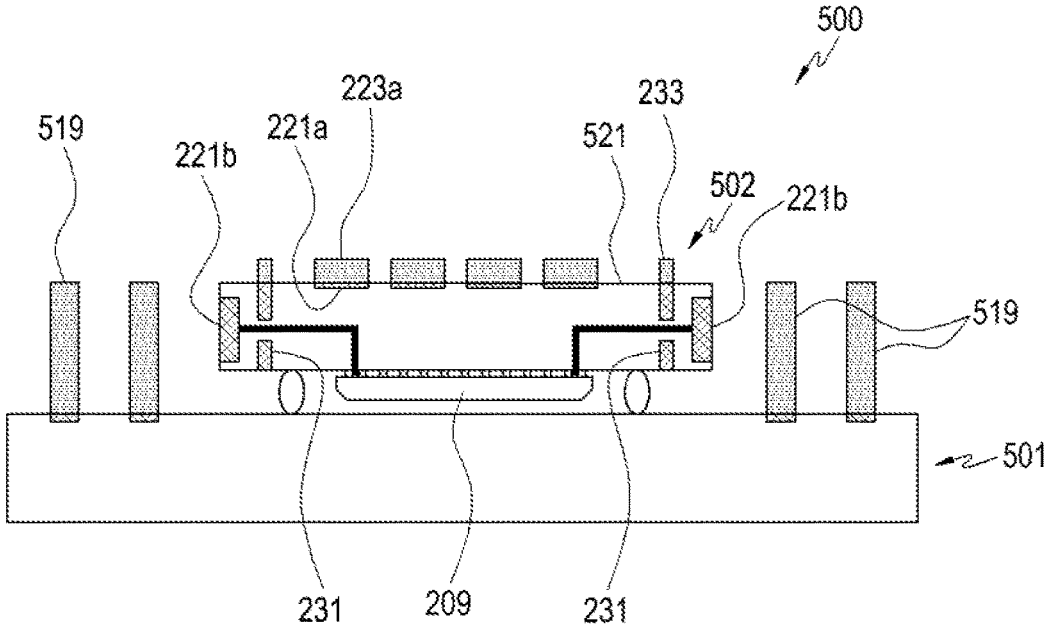
FIG. 32 is a sectional view illustrating a part of an electronic device that includes an antenna device according to an embodiment of the present disclosure.

FIG. 32 is a sectional view illustrating a part of an electronic device 500 that includes an antenna device according to an embodiment of the present disclosure.

Figure 33:
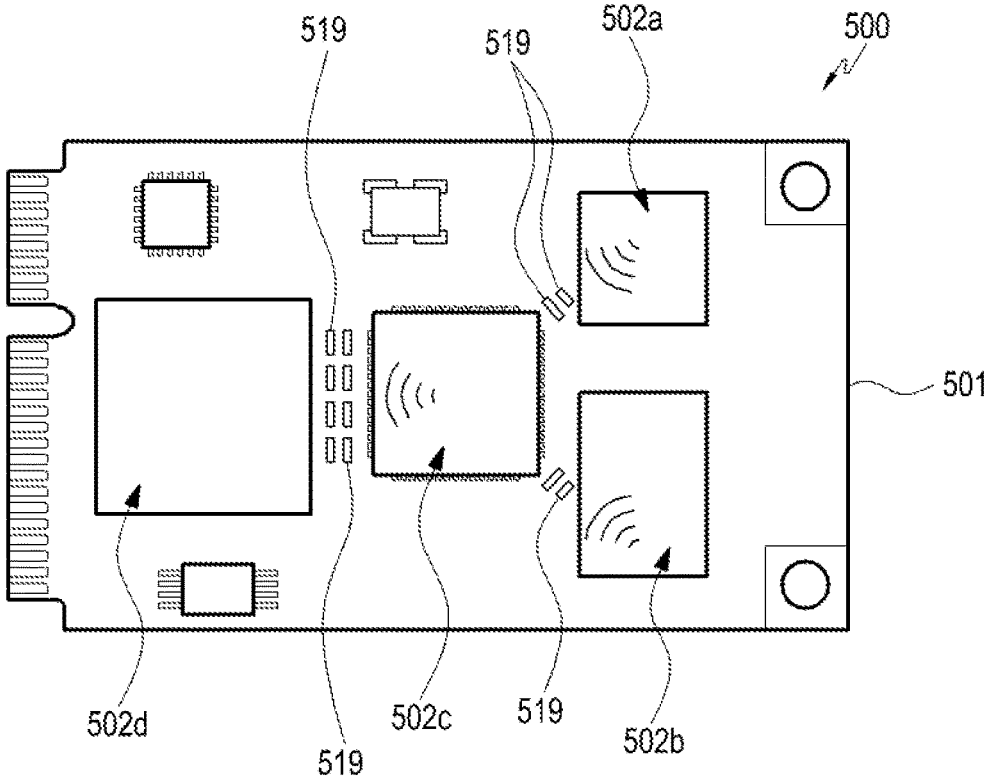
FIG. 33 is a plan view illustrating the main circuit board of the electronic device that includes the antenna device according to the embodiment of the present disclosure illustrated in FIG. 32.

FIG. 33 is a plan view illustrating the main circuit board of the electronic device 500 that includes the antenna device according to the embodiment of the present disclosure illustrated in FIG. 32.

In the following description of this embodiment, the main circuit board 501 and electronic components disposed thereon, rather than the entire structure of the electronic device, are illustrated in the drawings for brevity of the description, and the configuration thereof will be described with reference to the drawings.

Referring to FIGS. 32 and 33, the electronic device 500 (e.g., the electronic device 100 illustrated in FIG. 1) may include the main circuit board 501 having integrated circuit chip(s) 502, 502*a*, 502*b*, 502*c*, 502*d* mounted thereon. For example, the integrated circuit chip(s) 502, 502*a*, 502*b*, 502*c*, 502*d* may include an integrated circuit board 521 having a semiconductor chip embedded therein, and the antenna device(s) of the above embodiments may be mounted on the integrated circuit board 521. For example, the integrated circuit chip(s) 502, 502*a*, 502*b*, 502*c*, 502*d* may include: the integrated circuit board 521; one or more radiation conductors 221*a*, 221*b* on one surface and/or a side surface of the integrated circuit board 521; ground conductors 231 disposed within the integrated circuit board 521; and/or dummy conductor(s) 223*a*, 233 mounted on at least one of the radiation conductors 221*a*, 221*b* and the ground conductor 231 and/or on the respective radiation and ground conductors. A radio frequency module 209 may be mounted on the opposite surface of the integrated circuit board 521 to supply feeding signals to the radiation conductor(s) 221*a*, 221*b* through a feeding line formed within the integrated circuit board 521 and/or on the surface thereof.

The integrated circuit chip(s) 502, 502*a*, 502*b*, 502*c*, 502*d* may be mounted on the main circuit board 501 of the electronic device 500 to transmit and receive radio signals with other integrated circuit chip(s), which are mounted on the main circuit board 501, through the radiation conductors 221*a*, 221*b*. According to various embodiments, the main circuit board 501 may further include repeating conductors 519 disposed between the integrated circuit chip(s) 502, 502*a*, 502*b*, 502*c*, 502*d*. The repeating conductors 519 may relay radio signals transmitted between the integrated circuit chip(s) 502, 502*a*, 502*b*, 502*c*, 502*d* to enhance the transmission efficiency of the integrated circuit chip(s) 502, 502*a*, 502*b*, 502*c*, 502*d*, for example, the antenna devices mounted on the respective integrated circuit chip(s) 502, 502*a*, 502*b*, 502*c*, 502*d*.

As described above, an antenna device, according to various embodiments of the present disclosure, may include: a radiation conductor formed on a circuit board constituted by multiple layers, the radiation conductor being constituted by an electrically conductive pattern formed on at least one of the multiple layers constituting the circuit board or by a combination of electrically conductive patterns formed on the multiple layers; a ground conductor disposed on the circuit board to supply reference potential for the radiation conductor; a feeding line disposed on the circuit board to supply power to the radiation conductor; and a dummy conductor disposed on the circuit board, and the dummy conductor may be mounted to make contact with, or to be adjacent to, at least one of the radiation conductor, the ground conductor, and the feeding line.

According to various embodiments of the present disclosure, the radiation conductor may include at least one radiation patch disposed on one surface of the circuit board, and the dummy conductor may be mounted on the radiation conductor to protrude from the surface of the circuit board.

According to various embodiments of the present disclosure, the dummy conductor may include: a first surface that faces the radiation conductor; a second surface that is opposite to the first surface and has a larger area than the first surface; and a side surface that connects the first and second surfaces, and the side surface may be formed to be inclined with respect to the surface of the circuit board.

According to various embodiments of the present disclosure, the radiation conductor may include at least one radiation patch disposed on one surface of the circuit board, and the dummy conductor may be mounted on the radiation conductor to form an aperture antenna.

According to various embodiments of the present disclosure, the radiation conductor may be disposed on one side surface of the circuit board so as to be directed toward one side of the circuit board, and the dummy conductor may be mounted on at least one side edge of the radiation conductor.

According to various embodiments of the present disclosure, the radiation conductor may include: a first radiation conductor provided in an edge area of the circuit board and constituted by a combination of electrically conductive patterns formed on the respective layers and via holes formed through the multiple layers to connect the electrically conductive patterns of the adjacent layers; and a second radiation conductor provided within the circuit board and constituted by a combination of other electrically conductive patterns formed on the respective layers and other via holes formed through the multiple layers to connect the other electrically conductive patterns of the adjacent layers, and the first and second radiation conductors may be disposed adjacent to each other.

According to various embodiments of the present disclosure, a part of each of the first and second radiation conductors may be exposed through at least one of the opposite surfaces of the circuit board, and the dummy conductor may be mounted on at least one of the parts of the first and second radiation conductors that are exposed through the at least one surface of the circuit board.

According to various embodiments, of the present disclosure the radiation conductor may include a plurality of radiation patches disposed on one surface of the circuit board, and the dummy conductor may provide diaphragm structures disposed between the radiation conductors.

According to various embodiments of the present disclosure, the radiation conductor may be disposed on one side surface of the circuit board so as to be directed toward one side of the circuit board; the ground conductor may be disposed within the circuit board to face the radiation conductor while at least a part of the ground conductor is exposed through at least one of the opposite surfaces of the circuit board; and the dummy conductor may be mounted on at least one of the parts of the ground conductor that are exposed through the at least one surface of the circuit board.

According to various embodiments of the present disclosure, different parts of the ground conductor may be exposed through the opposite surfaces of the circuit board, and a plurality of dummy conductors may be mounted on the parts of the ground conductor exposed through the opposite surfaces of the circuit board, respectively.

According to various embodiments of the present disclosure, the dummy conductor may include: a first surface that faces the radiation conductor; a second surface that is opposite to the first surface and has a larger area than the first surface; and a side surface that connects the first and second surfaces, and the side surface may be formed to be inclined with respect to one surface of the circuit board.

According to various embodiments of the present disclosure, the side surface inclined with respect to the surface of the circuit board may be located to be directed toward the radiation conductor.

According to various embodiments of the present disclosure, the antenna device may further include a second dummy conductor mounted on at least one side edge of the radiation conductor.

According to various embodiments of the present disclosure, the feeding line may include a printed circuit pattern, at least a part of which extends on one surface of the circuit board, and the dummy conductor may be mounted to surround the area where the printed circuit pattern extends on the surface of the circuit board such that a feeding waveguide may be formed on the surface of the circuit board by means of the dummy conductor and the area where the printed circuit pattern extends.

According to various embodiments of the present disclosure, at least two different parts of the printed circuit pattern may extend parallel to each other, and the dummy conductor may include: a first dummy conductor mounted to surround the first of the two parts of the printed circuit pattern that extend parallel to each other; and a second dummy conductor mounted to surround the second of the two parts of the printed circuit pattern that extend parallel to each other.

According to various embodiments of the present disclosure, the radiation conductor may include: at least one first radiation conductor mounted on one surface of the circuit board; and at least one second radiation conductor mounted on a side surface of the circuit board, and the antenna device may further include a radio frequency (RF) module mounted on the opposite surface of the circuit board.

According to various embodiments of the present disclosure, the first and second radiation conductors may receive feeding signals from the radio frequency module.

According to various embodiments of the present disclosure, the radiation conductor may include: at least one first radiation conductor disposed on one surface of the circuit board; and at least one second radiation conductor disposed on a side surface of the circuit board, and the dummy conductor may include: a first dummy conductor mounted to face the first radiation conductor; and a second dummy conductor mounted on at least one side edge of the second radiation conductor.

According to various embodiments of the present disclosure, the electronic device may include a main circuit board, and a plurality of integrated circuit chips mounted on the main circuit board, and the integrated circuit chips may have the antenna device according to any of the above described embodiments to perform radio communication with each other.

According to various embodiments of the present disclosure, the electronic device may further include at least one repeating conductor mounted on the main circuit board and located between the integrated circuit chips, and the repeating conductor may relay radio signals transmitted between the integrated circuit chips.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna device comprising:

a plurality of radiation conductors formed on a circuit board constituted by multiple layers, the plurality of radiation conductors being constituted by a combination of electrically conductive patterns formed on the multiple layers;

at least one ground conductor disposed on the circuit board to supply a reference potential for the plurality of radiation conductors;

at least one feeding line disposed on the circuit board to supply power to the plurality of radiation conductors; and a plurality of dummy conductors disposed on the circuit board, wherein a portion of the plurality of dummy conductors are configured to contact with a portion of the plurality of radiation conductors, respectively, wherein the plurality of radiation conductors includes a first radiation conductor provided in an edge area of the circuit board and a second radiation conductor provided within the circuit board, wherein the first radiation conductor is disposed adjacent to the second radiation conductor such that the first radiation conductor is configured to be capacitively coupled to the second radiation conductor, and wherein the second radiation conductor is configured to be electrically coupled to the at least one feeding line.

2. The antenna device of claim 1, wherein the plurality of radiation conductors further comprises at least one radiation patch formed by an electrically conductive pattern, the electrically conductive pattern is disposed on one surface of the circuit board, and wherein at least one dummy conductor of the plurality of dummy conductors is mounted on the at least one radiation patch to protrude from the surface of the circuit board.

3. The antenna device of claim 2, wherein the at least one dummy conductor mounted on the at least one radiation patch comprises:

a first surface that faces the at least one radiation patch;

a second surface that is opposite to the first surface and has a larger area than the first surface; and a side surface that connects the first and second surfaces, and wherein the side surface is formed to be inclined with respect to the surface of the circuit board.

4. The antenna device of claim 1, wherein the first radiation conductor or the second radiation conductor further comprises at least one radiation patch formed by an electrically conductive pattern, the electrically conductive pattern is disposed on one surface of the circuit board, and wherein a dummy conductor is mounted on the first radiation conductor or the second radiation conductor to form an aperture antenna.

5. The antenna device of claim 1, wherein a group of the plurality of radiation conductors are disposed on one side surface of the circuit board so as to be directed toward one side of the circuit board, and wherein a group of the plurality of dummy conductors are mounted on at least one side edge of the plurality of radiation conductors directed toward the one side of the circuit board.

6. The antenna device of claim 1, wherein the first radiation conductor is constituted by a combination of electrically conductive patterns formed on the respective layers and via holes formed through the multiple layers to connect the electrically conductive patterns of the adjacent layers, and wherein the second radiation conductor is constituted by a combination of other electrically conductive patterns formed on the respective layers and other via holes formed through the multiple layers to connect the other electrically conductive patterns of the adjacent layers.

7. The antenna device of claim 6, wherein a part of each of the first and second radiation conductors is exposed through at least one of the opposite surfaces of the circuit board, and wherein another group of the plurality of dummy conductors are mounted on at least one of the parts of the first and second radiation conductors that are exposed through the at least one surface of the circuit board.

8. The antenna device of claim 1, wherein the first radiation conductor or the second radiation conductor further comprises a plurality of radiation patches formed by electrically conductive patterns, the electrically conductive patterns are disposed on one surface of the circuit board, and wherein a dummy conductor provides diaphragm structures between the radiation patches on the surface of the circuit board.

9. The antenna device of claim 1, wherein the feeding line comprises a printed circuit pattern, at least a part of the printed circuit pattern extends on one surface of the circuit board, and wherein another portion of the plurality of dummy conductors are mounted to surround the area where the printed circuit pattern extends on the surface of the circuit board such that a feeding waveguide is formed on the surface of the circuit board by the dummy conductor and the area where the printed circuit pattern extends.

10. The antenna device of claim 9, wherein at least two different parts of the printed circuit pattern extend parallel to each other, and wherein the other portion of the dummy conductors comprises:

a first dummy conductor mounted to surround the first of the at least two different parts of the printed circuit pattern that extend parallel to each other, and a second dummy conductor mounted to surround the second of the at least two different parts of the printed circuit pattern that extend parallel to each other.

11. The antenna device of claim 1, wherein another group of the plurality of dummy conductors is configured to make contact with the at least one ground conductor.

12. The antenna device of claim 1, wherein another group of the plurality of dummy conductors is configured to be adjacent to the at least one feeding line.

13. An antenna device comprising:

a plurality of radiation conductors formed on a circuit board constituted by multiple layers, the plurality of radiation conductors being constituted by an electrically conductive pattern formed on at least one of the multiple layers constituting the circuit board or by a combination of electrically conductive patterns formed on the multiple layers;

at least one ground conductor disposed on the circuit board to supply a reference potential for the plurality of radiation conductors;

at least one feeding line disposed on the circuit board to supply power to the plurality of radiation conductors; and a plurality of dummy conductors disposed on the circuit board, wherein a portion of the plurality of dummy conductors are configured to contact with a portion of the plurality of radiation conductors, respectively, wherein a group of the plurality of radiation conductors are disposed on one side surface of the circuit board so as to be directed toward one side of the circuit board, wherein the at least one ground conductor is disposed within the circuit board to face the group of the plurality of radiation conductors directed toward the one side of the circuit board while a part of the at least one ground conductor is exposed through at least one of the opposite surfaces of the circuit board, and wherein a group of the plurality of dummy conductors are mounted on the part of the at least one ground conductor which is exposed through the at least one of the opposite surfaces of the circuit board.

14. The antenna device of claim 13, wherein different parts of the at least one ground conductor are exposed through the opposite surfaces of the circuit board, and wherein a different group of the plurality of dummy conductors is mounted on the different parts of the at least one ground conductor exposed through the opposite surfaces of the circuit board, respectively.

15. The antenna device of claim 13, wherein the group of the plurality of dummy conductors comprise:

a first surface that faces the part of the at least one ground conductor, a second surface that is opposite to the first surface and has a larger area than the first surface, and a side surface that connects the first and second surfaces, and wherein the side surface is formed to be inclined with respect to one surface of the circuit board.

16. The antenna device of claim 15, wherein the side surface inclined with respect to the surface of the circuit board is directed toward the group of the radiation conductors directed toward the one side of the circuit board.

17. The antenna device of claim 13, further comprising:

a second dummy conductor mounted on at least one side edge of a radiation conductor.

18. An electronic device comprising:

a main circuit board; and a plurality of integrated circuit chips mounted on the main circuit board, wherein the plurality of integrated circuit chips have an antenna device to perform radio communication with each other, wherein the antenna device comprises:

a plurality of radiation conductors formed on a circuit board constituted by multiple layers, the plurality of radiation conductors being constituted by a combination of electrically conductive patterns formed on the multiple layers;

at least one ground conductor disposed on the circuit board to supply reference potential for the plurality of radiation conductors;

at least one feeding line disposed on the circuit board to supply power to the plurality of radiation conductors; and a plurality of dummy conductors disposed on the circuit board, wherein a portion of the plurality of dummy conductors are configured to contact with a portion of the plurality of radiation conductors, respectively, wherein the plurality of radiation conductors includes a first radiation conductor provided in an edge area of the circuit board and a second radiation conductor provided within the circuit board, wherein the first radiation conductor is disposed adjacent to the second radiation conductor such that the first radiation conductor is configured to be capacitively coupled to the second radiation conductor, and wherein the second radiation conductor is configured to be electrically coupled to the at least one feeding line.

19. The electronic device of claim 18, further comprising:

at least one repeating conductor mounted on the main circuit board and located between the plurality of integrated circuit chips, wherein the at least one repeating conductor relays radio signals transmitted between the plurality of integrated circuit chips.

* * * * *